US010974303B2

(12) United States Patent
Ito

(10) Patent No.: US 10,974,303 B2
(45) Date of Patent: Apr. 13, 2021

(54) SLIDING FRICTIONAL FORCE GENERATION MECHANISM BY FITTING AND DIE CUSHION FOR PRESS MACHINE

(71) Applicant: AIDA ENGINEERING, LTD., Kanagawa (JP)

(72) Inventor: Takao Ito, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 567 days.

(21) Appl. No.: 15/820,046

(22) Filed: Nov. 21, 2017

(65) Prior Publication Data

US 2018/0154419 A1 Jun. 7, 2018

(30) Foreign Application Priority Data

Nov. 25, 2016 (JP) ..... JP2016-229608
Oct. 27, 2017 (JP) ..... JP2017-208660

(51) Int. Cl.

| | |
|---|---|
| ***B21D 24/02*** | (2006.01) |
| ***B21D 24/06*** | (2006.01) |
| ***B30B 15/28*** | (2006.01) |
| ***B30B 15/02*** | (2006.01) |

(52) U.S. Cl.

CPC ..... *B21D 24/02* (2013.01); *B21D 24/06* (2013.01); *B30B 15/026* (2013.01); *B30B 15/281* (2013.01)

(58) Field of Classification Search

CPC . B21B 45/0239; B21B 45/0245; B23Q 11/10; B23Q 11/121; B23Q 11/122; B21D 24/02; B23B 31/40

See application file for complete search history.

(56) References Cited

U.S. PATENT DOCUMENTS

| | | | | |
|---|---|---|---|---|
| 3,582,157 | A | 6/1971 | Hammon | |
| 2004/0020249 | A1 | 2/2004 | Battermann et al. | |
| 2011/0223300 | A1* | 9/2011 | Purgatorio | A23L 5/15 426/418 |
| 2011/0250827 | A1* | 10/2011 | Smith | B24B 45/00 451/449 |
| 2014/0369865 | A1 | 12/2014 | Marsal et al. | |

FOREIGN PATENT DOCUMENTS

| | | | |
|---|---|---|---|
| EP | 2377629 | A1 | 10/2011 |
| EP | 2716383 | A2 | 4/2014 |
| JP | 01-264705 | A | 10/1989 |

(Continued)

OTHER PUBLICATIONS

Japanese Office Action issued in corresponding Japanese Patent Application No. 2017-208660, dated Oct. 30, 2018, with English Translation.

(Continued)

*Primary Examiner* — Debra M Sullivan
(74) *Attorney, Agent, or Firm* — McDermott Will & Emery LLP

(57) ABSTRACT

A sliding frictional force generation mechanism includes a metal hole member having a hole, a metal shaft member fitted in the hole of the hole member in an axially slidable manner, and a lubrication mechanism configured to supply lubricating oil serving as a cooling medium between the holed ember and the shaft member. The shaft member is fitted in the hole in an interference fit state.

5 Claims, 14 Drawing Sheets

(56) References Cited

FOREIGN PATENT DOCUMENTS

| | | | |
|---|---|---|---|
| JP | H05-248468 | A | 9/1993 |
| JP | H06-170651 | A | 6/1994 |
| JP | H06-179126 | A | 6/1994 |
| JP | H07-2020 | U | 1/1995 |
| JP | 2003-529028 | A | 9/2003 |
| JP | 2015-031385 | A | 2/2015 |
| WO | 01/073313 | A2 | 10/2001 |

OTHER PUBLICATIONS

BIS Technical Committee ISO/TC 213, 2010, "Geometrical Product Specifications (GPS)—ISO code system for tolerances on linear sizes. Part 1: Basis of tolerances, deviations and fits (ISO 286-1:2010)."

* cited by examiner

Shape of punched product

First time

Second time and thereafter

Friction pin 99
Sliding Portion

X 3000

Friction pin 99
Non sliding portion

X 3000

X 5000(Before use)

X 5000 (After use)

SLIDING FRICTIONAL FORCE GENERATION MECHANISM BY FITTING AND DIE CUSHION FOR PRESS MACHINE

BACKGROUND OF THE INVENTION

Technical Field

The present disclosure relates to a sliding frictional force generation mechanism by fitting and a die cushion for a press machine using the sliding frictional force generation mechanism.

Description of the Related Art

The following description of related art sets forth the inventor's knowledge of related art and certain problems therein and should not be construed as an admission of knowledge in the prior art.

For a fitting of a shaft in a hole, there are known a "clearance fit" for obtaining a slidable fit, an "interference fit" for fixing a shaft in a hole, and a "transition fit" which is an intermediate fit between these two fits. They are selected by specifying a dimensional tolerance of a hole diameter and a shaft diameter. These are known, for example, in Non-Patent Document 1, etc. According to the "4.10.2" of Patent Document 1, an interference fit is defined as "a fit which always causes a tightening margin when assembling a hole and a shaft". Such an interference fit is used in cases where the assembled members are basically not subjected to moving or disassembling after the assembly. In assembling, a press fit, a shrink fit, and a cold-fit are required.

On the other hand, as a device utilizing a sliding frictional force, a friction damper for attenuating vibrations of a fully automatic washing machine during spin-drying (see Patent Document 1) and a friction damper for attenuating shaking of a building during an earthquake (Patent Document 2) are known. In these friction dampers, a piston is slidably accommodated in a cylinder, and a friction material is provided on the outer periphery of the piston so as to obtain a predetermined frictional force.

In Patent Document 1, it does not refer to the material of the friction material and the material is selected appropriately. Patent Document 2 discloses, as a friction material, the use of a synthetic resin, sintered metal, a metal sheet made of expanded metal or a wire mesh, or porous sintered metal which is filed with a polyimide resin or PTFE. In these friction dampers, although a sliding frictional resistance is utilized, they merely absorb vibration energy in a high rotational range and diverge the energy as thermal energy. For this reason, a high frictional force cannot be stably generated in a driving cycle of a press machine.

Patent Document 3 discloses a magnetic control friction damper that can control a tightening margin by controlling magnetism. In the paragraph [0013] of Patent Document 3, various applications of a friction damper are exemplified. As a friction material, a synthetic resin, such as, e.g., polyethylene and nylon, is exemplified.

In an injection molding die, in cases where an upper die is integrally produced, the die assembly deflects by an injection pressure, which causes burrs in a gap between the lower die and the upper die. In order to avoid such a problem, Patent Document 4 teaches a technique in which a first core piece and a second core piece are separately formed and fitted in an upper die. For this reason, even if a deflection occurs in the upper die, each core piece comes into close contact with the lower die by the material pressure caused by being pressed by the upper die. At this time, in order to prevent generation of burrs due to material penetration through the parting surfaces, the core piece is slidably interference-fitted to the upper die. However, the tightening margin is slight. This technology rather relates to a sealing structure and does not teach the use of a frictional force.

PRIOR ART

Patent Document

Patent Document 1: Japanese Unexamined Patent Application Publication No. H05-248468

Patent Document 2: Japanese Unexamined Patent Application Publication No. 2015-031385

Patent Document 3: Japanese Translation of PCT International Application Publication No. JP-T-2003-529028

Patent Document 4: Japanese Unexamined Utility Model Application Publication No. H07-2020

Non-Patent Document

Non-Patent Document 1: JIS B0401-1 (1988) "Method of Dimensional Tolerance and Fit Part 1: Basic of Tolerance, Dimensional Difference, and Fit"

SUMMARY OF THE INVENTION

Problems to be Solved by the Invention

When blanking a workpiece made of a metal plate with a press machine, in some cases, using a counter punch for clamping a workpiece together with a punch, in some cases, fine shearing of the workpiece by a die and a punch is assisted by making a counter punch follow the descent of the punch. In order to generate a force to support such a counter punch, a die cushion utilizing air pressure, oil pressure, or a spring is used. Such a die cushion is also used when applying back pressure to a blank holder clamping a periphery of a workpiece together with a die at the time of subjecting the workpiece to drawing.

Such a die cushion is equipped in a frame or a slide of a press machine. For this reason, in the case of a large area cushion specification, the frame rigidity of the press machine decreases, which may sometimes cause wrinkles or cracks due to the lack of rigidity or may sometimes cause insufficient forming accuracy at the time of shaping a high tensile strength material, such as, e.g., a ultra-high tensile strength material. Further, positions of cushion pins at the time of designing a die are limited to the specification of the cushion pin positions determined by the press machine, which also becomes a factor to hinder the optimum die design.

Further, in a die cushion utilizing air pressure or a spring property of a coil spring or an elastomer, a load increases as the push-in amount increases. For this reason, designing the load is complicated, and in cases where a uniform load is required, it is necessary to combine with other die cushions. On the other hand, in the case of utilizing hydraulic relief pressure for cushion pressure, since the cushion pressure depends on a speed, there is a problem that the cushion pressure decreases when the speed is decelerated, for example, at the bottom dead center of the press machine.

On the other hand, in a friction damper used for conventional washing machines, etc., a friction material which is assumed to be abraded, such as, e.g., rubber, a synthetic resin, a copper based alloy, and an aluminum based alloy, is used to protect the main material made of steel, etc. Therefore, such a friction material cannot be used for equipment required to withstand strong force such as a die cushion of a press machine. On the other hand, although a friction damper used for vibration control of buildings can withstand a strong force, it is not suitable to perform precise operation, and in cases where it is used repeatedly for a long period of time, durability is low.

The technical object of some embodiments of the present invention is to provide a sliding frictional force generation mechanism capable of stably exerting a large load force, high in durability, and capable of suppressing occurrence of seizure and galling, whereby it can be used for a machine requiring high load, such as, e.g., a die cushion or a knockout overload prevention device of a press machine and an overload protector device for a press machine.

Means for Solving the Problems

A sliding frictional force generation mechanism according to some embodiments of the present invention includes a metal hole member having a hole, a metal shaft member slidably fitted in the hole of the hole member in an axial direction, and a lubrication mechanism configured to supply lubricating oil serving as a cooling medium between the hole member and the shaft member. The shaft member is fitted in the hole in an interference fit state.

In such a sliding frictional force generation mechanism, it is preferable that a passage through which the lubricating oil or another cooling medium flows be formed in at least one of the hole member and the shaft member. Further, it is preferable that both the hole member and the shaft member be made of carbon steel and a surface hardening treatment be subjected to at least one of or both of sliding surfaces of the hole member and the shaft member. It is preferable that surface roughness Ra of the hole and the shaft member be 0.2 μm or less. The surface roughness Ra is preferably 0.01 to 0.2 μm, more preferably 0.08 to 0.2 μm.

A die cushion device for a press machine according to some embodiments of the present invention includes any of the aforementioned sliding frictional force generation mechanisms, and a return mechanism configured to return the shaft member pushed in to a state before being pushed in. The sliding frictional force generation mechanism is used for clamping a workpiece as a reaction force or resistance generation source of press working. A die for a press machine according to some embodiments of the present invention is characterized in that any one of the aforementioned sliding frictional force generation mechanisms is used as a reaction force or resistance force generation source of processing pressure to be applied to a die.

A die cushion device according to anther embodiment of the present invention includes any one of the aforementioned sliding frictional force generation mechanisms and a reversing mechanism or a turn-over mechanism configured to reverse the sliding frictional force generation mechanism. The hole of the hole member of the sliding frictional force generation mechanism is a through-hole. The length of the shaft member is made to be longer than the hole. The reversing mechanism is configured to reverse the sliding frictional force generation mechanism for each pressurization of a press machine, whereby the reversing mechanism is served as the return mechanism.

A relief type die cushion device according to some embodiments of the present invention includes a hydraulic cylinder composed of a cylinder and a piston and exerts a cushion force by resistance of hydraulic oil coming out of the hydraulic cylinder. Among the inner surface of the cylinder and the outer surface of the piston, portions that are in sliding contact with each other at near the bottom dead center of the press machine constitute any one of the sliding frictional force generation mechanisms.

A method for producing a sliding frictional force generation mechanism according to some embodiments of the present invention includes fitting a shaft member in a hole member by a cold-fit.

In the sliding frictional force generation mechanism according to some embodiments of the present invention, an external force receiving portion for alternately receiving a pushing force is provided at one end and the other end of the shaft member, or an external force receiving portion for alternately receiving a pushing force and a pulling force at one end of the shaft member. The sliding frictional force generation mechanism is used so as to generate a frictional force in a direction opposite to a moving direction by an external force. At this time, since both the shaft member and the hole member are made of metal and the hole and the shaft member can slide relative to each other in the axial direction in the interference fit state, a high frictional force (dynamic friction) corresponding to the tightening margin is generated. When the length of the sliding portion (the length of the friction hole 36 in FIG. 12) is constant, the frictional force hardly changes depending on the push-in amount of the shaft member, which exerts stable load capability. Further, the speed dependence is low.

Further, since it is configured such that metals slide with each other simply by interposing lubricating oil without interposing a friction member made of a material which easily wears such as synthetic resin or soft metal, it can cope with a strong pressing force and the durability is high. The shaft member and the hole slide via the lubricating oil supplied from the lubrication mechanism, and the frictional heat caused by the sliding is cooled by the lubricating oil. For this reason, seizure and galling hardly occur, which exerts a uniform frictional force over a long period of time.

In cases where a passage for flowing the lubricating oil or another cooling medium is formed in at least one of the hole member and the shaft member, the flow rate of the cooling medium can be increased by increasing the passage cross-sectional area, and therefore the cooling efficiency can be enhanced. In cases where both the hole member and the shaft member are made of carbon steel and at least one of or both of sliding surfaces are subjected to a hardening treatment, seizure and galling prevention effects are high. When the surface roughness Ra of the hole and that of the shaft member is 0.2 μm or less, especially when the surface roughness Ra is 0.01 to 0.2 μm, further when the surface roughness Ra is 0.08 to 0.2 μm, the lubricating oil has a high oil film maintaining effect, which further suppresses occurrence of seizure and/or galling.

The die cushion device according to some embodiments of the present invention exerts the aforementioned frictional force generating action when the shaft member is pushed into the hole of the hole member. Since the return mechanism returns the shaft member to its original state by the return mechanism, a frictional force can be generated repeatedly. Furthermore, since it is more compact than a die cushion using a conventional air pressure or a hydraulic pressure, even in the case of exerting a large cushion force, the rigidity of the frame and the slide is not greatly impaired. Further, since the structure is configured simply by the shaft member and the hole member, the die cushion device can be arranged at an appropriate position in accordance with the form of the die and/or the forming condition. As the return mechanism, an air type die cushion, a hydraulic type die cushion, a cam driven knockout device, etc., can be used. Since the die of some embodiments of the present invention is equipped with the sliding frictional force generation mechanism, it can exert a cushion force by itself.

The die cushion device equipped with the aforementioned reversing mechanism can return the shaft member to the original position, that is, the state before deeply being fitted into the hole, by reversing the sliding frictional force generation mechanism by the reversing device. Therefore, it is not required to use an external device, such as, e.g., an air type die cushion or a hydraulic type die cushion, so it can be made compact. Further, since there is no step of returning the shaft member to its original position, heat generation due to friction can be reduced.

The relief type die cushion according to some embodiments of the present invention generates a cushion force by normal relief back pressure until it reaches near the bottom dead center. In the vicinity of the bottom dead center, the inner surface of the cylinder and the outer circumferential surface of the piston slide with each other at a predetermined range, causing large sliding frictional resistance. Therefore, it becomes possible to complement a relief type die cushion in which the resistance force becomes small at the bottom dead center.

In the method for producing a frictional force generating mechanism according to some embodiments of the present invention, since the hole member and the shaft member are fitted by a cold-fit, the members are less damaged as compared with the case of a shrink fit or a press fit. By sufficiently adhering lubricating oil, etc., to the shaft member and the hole of the hole member when further fitting the cooled shaft member into the hole of the hole member, it becomes possible to further suppress occurrence of seizure and galling.

BRIEF DESCRIPTION OF THE DRAWINGS

Some embodiments of the present disclosure are shown by way of example, and not limitation, in the accompanying figures.

FIG. 4A and FIG. 4B show still another embodiment of a die cushion device of the present invention, wherein FIG. 4A is a configuration diagram in a state in which the die cushion device is attached to a press machine, and FIG. 4B is a plan view of the die cushion device.

FIG. 5A and FIG. 5B show an application example in which the die cushion of the present invention is used for fine blanking, wherein FIG. 5A is a cross-sectional view of dies, and FIG. 5B is a front view of a punched product.

FIG. 6A and FIG. 6B show a still another embodiment of the die cushion device of the present invention, wherein FIG. 6A is a front view in a state in which the die cushion device is attached to a press, and FIG. 6B is a plan view thereof.

FIG. 7A and FIG. 7B show essential parts of the die cushion device of FIG. 6A, wherein FIG. 7A is a front cross-sectional view thereof, and FIG. 7B is a side cross-sectional view thereof.

FIG. 9A and FIG. 9B show still another embodiment of a die cushion device using the frictional force generating mechanism of the present invention, wherein FIG. 9A shows a state in which a press machine is in the top dead center, and FIG. 9B shows a state in which the press machine is in the bottom dead center.

EMBODIMENTS FOR CARRYING OUT THE INVENTION

In the following paragraphs, some embodiments in the present disclosure will be described by way of example and not limitation. It should be understood based on this disclosure that various other modifications can be made by those in the art based on these illustrated embodiments.

Figure 1:
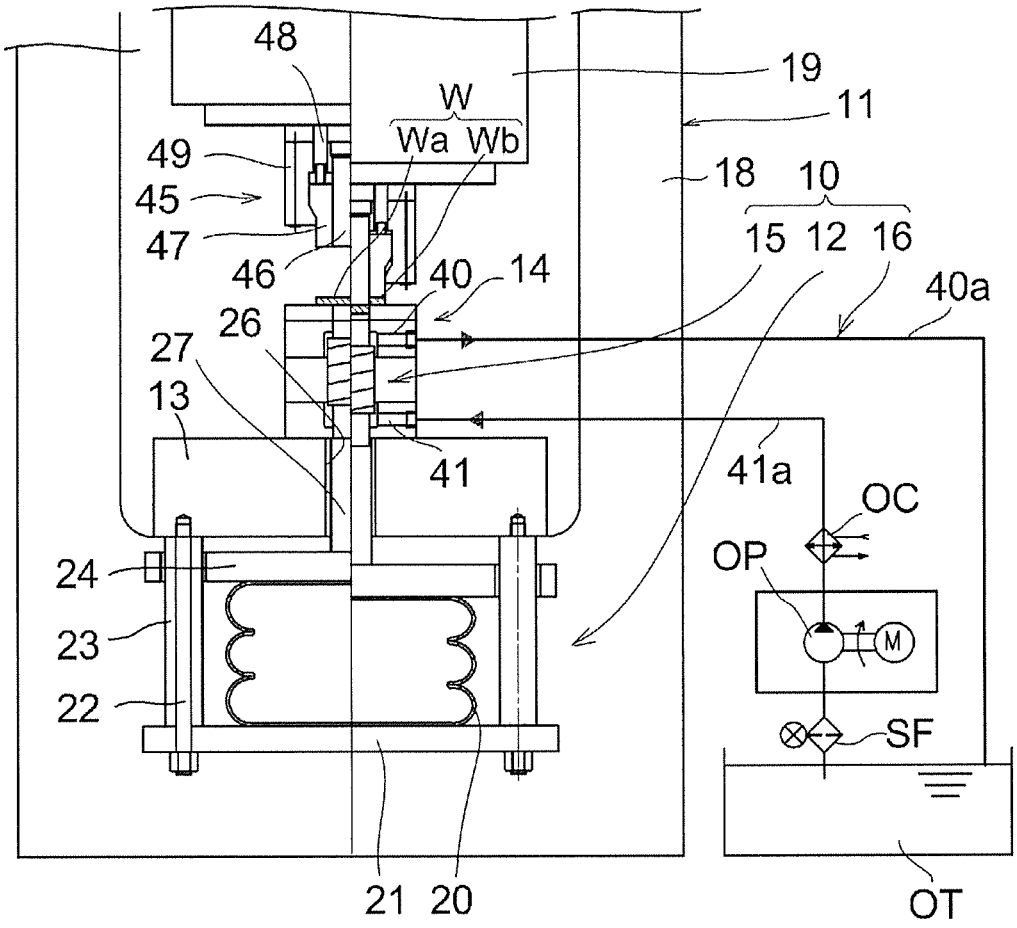
FIG. 1 is a configuration diagram showing one embodiment of a die cushion device of the present invention in a state in which the die cushion device is attached to a press machine.
Figure 2A:
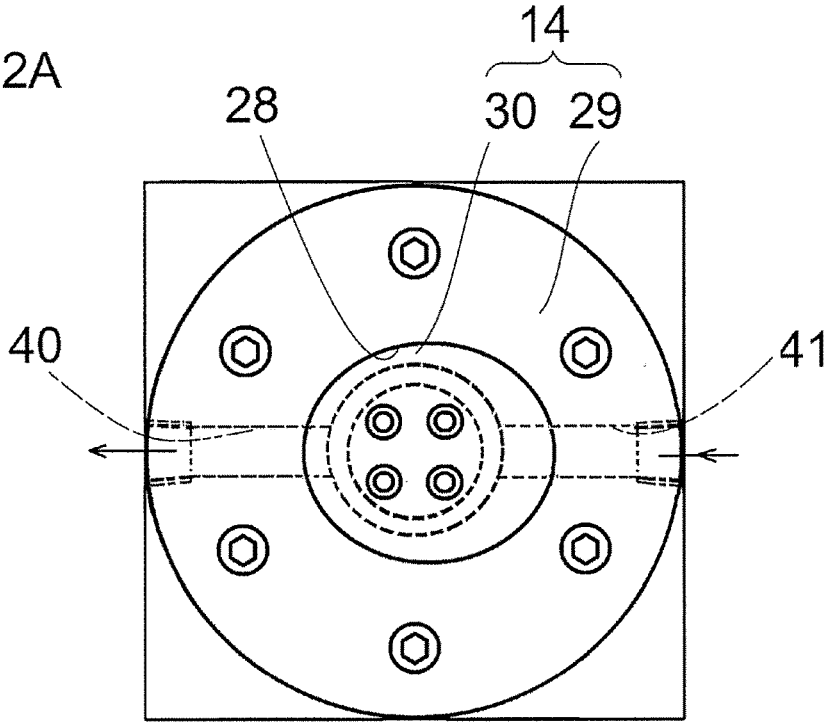
FIG. 2A and FIG. 2B are a plan view and a schematic longitudinal cross-sectional view of a sliding frictional force generation mechanism coupled to a die, respectively.
Figure 2B:
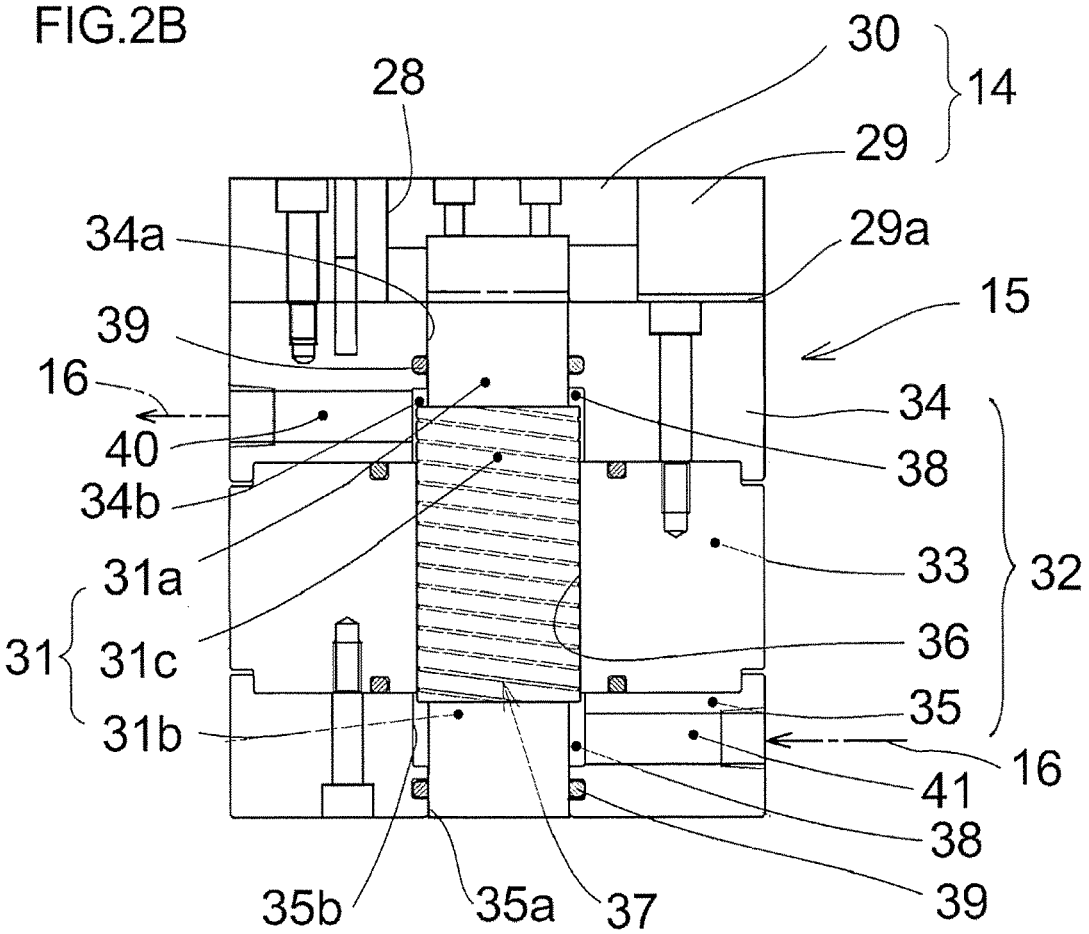

The die cushion device 10 shown in FIG. 1, FIG. 2A and FIG. 2B is composed of a normal pressure type air cushion device 12 attached to a press machine 11 and arranged below a bolster 13, and a friction die cushion 15 coupled to the lower portion of a lower die 14 arranged above the bolster 13. The reference numeral 16 denotes a supply system configured to circularly supply lubricating oil which also serves as cooling medium to the friction die cushion 15. The left side of FIG. 1 shows a state of the press machine 11 in which a slide 19 is raised and the right side shows a state in which the slide 19 is lowered. This also applies to FIG. 3 and FIG. 4A. The press machine 11 is composed of a frame 18, the aforementioned bolster 13, the slide 19 that moves up and down, and a known slide drive mechanism (not illustrated) that drives the slide 19 up and down.

The air cushion device 12 is composed of a plural staged bellows 20, air (pressurized air) filled in the bellows 20, a base plate 21 for supporting the lower part of the bellows 20, bolts 22 and pipes 23 for fixedly hanging the base plate 21 from the bolster 13, and a cushion pad 24 fixed to the upper end of the bellows 20. The cushion pad 24 is vertically slidably guided by the pipes 23. The air duct for supplying air to the bellows 20 is not illustrated.

In this embodiment, a through-hole 26 is formed in the center of the bolster 13, and a cushion pin 27 is slidably passed through the through-hole 26. The through-hole 26 and the cushion pin 27 may be plural (see FIG. 4A and FIG. 4B). The cushion pin 27 is a component arranged so as to penetrate the bolster 13 for transmitting the cushion force, and is usually formed in a cylindrical shape. The cushion pin 27 is used for various dies (lower die 14), and is not connected to the die but is merely in contact with the die. The cushion pin 27 merely comes into contact with the cushion pad 24. However, the cushion pin 27 may be coupled to the die 14 and/or the cushion pad 24 if necessary.

As shown in the upper part of FIG. 2B, the lower die 14 is provided with a die 29 having a punching hole 28 of a predetermined shape and a counter (counter punch) 30 slidably accommodated in the punching hole 28 via a minute clearance. A friction die cushion 15 is arranged below the lower die 14, and the friction die cushion 15 is fixed to the bolster 13 by bolts or the like (see FIG. 1). The friction die cushion 15 is composed of a friction pin 31 arranged below the counter 30 and a holder 32 for supporting the friction pin 31 in an upwardly and downwardly movable manner. The friction pin 31 has a contour smaller than the counter 30 and is usually cylindrical (see FIG. 2A). The counter 30 is fastened to the upper end of the friction pin 31 with bolts or the like, and the die 29 is fixed to the holder 32 with bolts or the like. The upper portion 31*a* and the lower portion 31*b* of the friction pin 31 are formed to be somewhat smaller in diameter than the intermediate portion 31*c*. The holder 32 is composed of a hub (hub plate) 33 corresponding to the intermediate portion 31*c* of the friction pin 31 and spacers 34 and 35 arranged on the upper side and the lower side of the hub 33, respectively. For sealing lubricating oil, it is preferable to seal the abutting surfaces of the hub 33 and spacers 34 and 35 with a seal ring or a gasket and fix the spacers 34 and 35 to the hub 33 with bolts or the like.

The hub 33 is provided with a friction hole 36 which slidably fits to the intermediate portion 31*c* of the friction pin 31 in an interference fit manner. The intermediate portion 31*c* of the friction pin 31 and the friction hole 36 constitute the sliding frictional force generation mechanism of the present invention. An annular or helical oil groove 37 is formed on the outer peripheral surface of the intermediate portion 31*c*, the inner surface of the friction hole 36, or both thereof. In the upper spacer 34, a guide hole 34*a* which is slidably fitted to the upper portion 31*a* of the friction pin 31 and an enlarged diameter portion 34*b* which does not come into sliding contact with the intermediate portion 31*c* and forms an oil pocket 38 between the upper portion 31*a* of the friction pin 31 and the enlarged diameter portion 34*b* are formed. In the same manner, in the lower spacer 35, a guide hole 35*a* which slidably fits to the lower portion 31*b* of the friction pin 31 and an enlarged diameter portion 35*b* which does not come into sliding contact with the intermediate portion 31*c* of the friction pin 31 and forms an oil pocket 38 between the the lower portion 31*b* and the enlarged diameter portion 35*b* are formed. An O-ring groove is formed on the inner surface of each of the guide holes 34*a* and 35*a*, and an O-ring 39 is accommodated therein. Passages 40 and 41 communicating the oil pockets 38 and 38 with the outside are formed in the upper and lower spacers 34 and 35.

The intermediate portion 31*c* of the friction pin 31 and the friction hole 36 are fitted in an interference fit state. That is, in a natural state in which they are not fitted with each other, the diameter of the intermediate portion 31*c* of the friction pin 31 is larger than the diameter of the friction hole 36 by the tightening margin. Then, the intermediate portion 31*c* of the friction pin 31 contracts elastically due to the fit, and correspondingly the friction hole 36 elastically expands in diameter. That is a so-called minus tolerance fit. For example, when the diameter of the intermediate portion 31*c* and the diameter of the friction hole 36 are 30 to 50 mm, it is preferable that the tightening margin be about 0.02 to 0.04 mm, particularly about 0.03 mm. When fitting the friction pin 31 to the friction hole 36 of the hub 33, a "cold-fit" method is used. According to this method, the friction pin 31 is preliminary cooled so as to be thermally contracted until the friction pin 31 becomes smaller in diameter than the friction hole 36. In this state, the friction pin 31 is inserted into the friction hole 36, then the friction pin 31 is returned to normal temperature to thereby cause a strongly fit. This makes it possible to perform an interference fit without damaging the material of the hub 33. Note that the interference fit may be performed by a shrink fit or a press fit. For a press fit, a lubricant, particularly lubricating oil, is applied on the friction surface before the press fit.

The friction pin 31 is preferably made of carbon steel, particularly cold die steel such as JIS standard DC53 steel. It is also preferable that the surface of the friction pin 31 be subjected to polishing and lapping into a very smooth surface with an arithmetic mean roughness Ra of 0.2 μm or less except for oil grooves when there are oil grooves. As for the lower limit, for the purpose of, e.g., maintaining the oil film, it is preferable to set the arithmetic mean roughness Ra to 0.01 μm or more, more preferably 0.08 μm or more considering the ease of processing. Therefore, the arithmetic mean roughness Ra is preferably within the range of 0.01 to 0.2 μm, particularly within the range of 0.08 to 0.2 μm. Further, it is preferable to subject the surface of the friction pin 31 to a hardening treatment, such as, e.g., a low-temperature TiC treatment. The surface hardness is set to about 55 to 65 in Rockwell C scale (HRC). In the same manner, the hub 33 is preferably made of alloy tool steel such as JIS standard SKD61 steel. It is also preferable that the friction hole 36 of the hub 33 be subjected to polishing and lapping into a very smooth surface with an arithmetic mean roughness Ra of 0.01 to 0.2 μm particularly 0.08 to 0.2 μm. Further, it is preferable to subject the surface of the friction hole 36 to a hardening treatment, such as, e.g., a radical nitriding treatment. The surface hardness is set to about 45 to 49 in Rockwell C scale (HRC). The friction pin 31 and the hub 33 are preferably as close as possible in thermal expansion coefficient, particularly preferably the same in thermal expansion coefficient. In this case, even in cases where the friction pin 31 and the hub 33 expand thermally, the friction pin 31 and the hub 33 expand in the same manner, which can suppress the change of the sliding frictional force.

As shown in FIG. 1, a lubricating oil supply system 16 is connected to the passages 40 and 41 of the upper and lower spacers 34 and 35. The supply system 16 includes a supply pipe line 41*a* extending from an oil tank OT to the passage 41 of the lower spacer 35 and a return line 40*a* connecting the passage 40 of the upper spacer 34 to the oil tank OT. Note that the supply pipe line 41*a* may be connected to the passage 40 of the upper spacer 34. A suction filter SF, an oil pump OP, and an oil cooler OC are interposed in the middle of the supply pipe line 41*a*. The oil cooler OC cools the lubricating oil to remove/dissipate frictional heat.

To the slide 19 of the press machine 11, an upper die 45 for blanking a workpiece W in cooperation with the lower die 14 is attached. The upper die 45 is a known die including a punch 46 having a tip end to be inserted into the punching hole 28 of the die 29, a blank holder 47 slidably provided around the punch 46, a spring (upper cushion) 48 for urging the blank holder 47 downward, and a die holder 49 for regulating the lower limit of the vertical movement of the blank holder 47.

The die cushion device 10 configured as described above functions when blanking is performed by lowering the slide 19 after placing a workpiece W on the lower die 14. That is, when the slide 19 is lowered, the blank holder 47 presses periphery of the workpiece W, and the punch 46 presses the workpiece W downward. At that time, the force (F1+F2) obtained by adding the urging force F1 of the air cushion device 12 and the frictional resistance F2 of the friction die cushion 15 is applied to the counter 30 upward. For this reason, the workpiece W is pressed downward while being strongly clamped by the punch 46 and the counter 30. Furthermore, the periphery of the workpiece W is also clamped by the blank holder 47 and the die 29 strongly. As a result, the central portion Wa of the workpiece W is punched out from the surrounding portion Wb.

Since both the central portion Wa and the surrounding portion Wb of the workpiece W are clamped from above and below, the workpiece W is sheared in almost the entire area from the upper surface to the lower surface of the workpiece W (total shearing). Therefore, as shown in FIG. 5B, a clean shear plane 52 with fewer shear droops 50 in which the corner is rounded or fewer burrs 51 due to the small clearance between the die 29 and the punch 46 can be obtained. The punched portion and the remaining hole are high in dimensional accuracy. Further, the punched product is high in flatness since it did not receive a strong bending force. That is, a fine blanking or a fine punching was performed.

When the slide 19 is raised and therefore the punch 46 is raised, the counter 30 will be raised by the upward urging force F1 applied to the air cushion device 12 via the cushion pin 27 and the friction pin 31. On the other hand, the frictional resistance F of the friction die cushion 15 acts so as to prevent the upward movement of the friction pin 31. Therefore, the counter 30 is raised with the upward lifting force of "F1-F". That is, in this embodiment, when the slide 19 is lowered, the air cushion device 12 and the friction die cushion 15 exert a cushioning effect, and when the slide 19 is raised, the air cushion device 12 acts as a "return mechanism" for returning the friction pin 31 to the original position.

The friction die cushion ability (frictional resistance) F is calculated by the product of the surface pressure p occurring between metals (sliding surfaces) by the interference fit, the area on which the surface pressure acts, and the friction coefficient The relationship between a tightening margin δ and generating surface pressure p in the fit is shown by Formula 1.

$$p = \frac{\delta}{D_1\left\{\frac{1}{E_1} + \frac{D_2^2 + D_1^2}{E_2(D_2^2 - D_1^2)} + \frac{\nu_2}{E_2} - \frac{\nu_1}{E_1}\right\}} \quad \text{[Formula 1]}$$

The friction die cushion ability F is the product of the surface pressure p, the friction coefficient μ, and the sliding area S at the sliding surface. Since the sliding area S is $\pi \times D_1 \times L$, the friction die cushion ability F is expressed by Formula 2.

$$F = p \times \mu \times (\pi \times D_1 \times L) \quad \text{[Formula 2]}$$

As the friction coefficient μ, a dynamic friction coefficient is adopted when the friction pin 31 is moving, and a static friction coefficient is adopted from the stationary state until it starts moving. Here, δ: tightening margin, $\nu_1$: Poisson's ratio of the friction pin, $\nu_2$: Poisson's ratio of the hub, $E_1$: Young's modulus of the friction pin, $D_1$: fit diameter of the friction pin, $E_2$: Young's modulus of the hub, $D_2$: outer diameter of the hub.

The friction coefficient μ varies in accordance with the viscous resistance of the lubricating oil, and the viscous resistance varies in accordance with temperature. Furthermore, the diameter of the friction hole and the diameter of the friction pin thermally expand in accordance with temperature. However, since the friction die cushion 15 in FIG. 1 is constantly cooled by the lubricating oil cooled by the oil cooler OC, there is little change, so the frictional resistance does not fluctuate greatly. Since smooth surfaces slide each other and are constantly lubricated with the lubricating oil, occurrence of seizure and/or galling of the friction surfaces can be prevented. It should be note that a passage for cooling oil as a cooling medium other than the lubricating oil may be formed in the hub 33 to cool the hub 33. In that case, since the passage cross-sectional area for the cooling oil can be increased, the hub 33 can be efficiently cooled. An inner passage of the hub 33 is preferably configured by a gap formed by concentrically arranging double cylinders configuring the hub 33. In this case, not only the passage cross-sectional area is large but also the contact area with the cooling medium is large, so the heat transfer efficiency is high.

Figure 3:
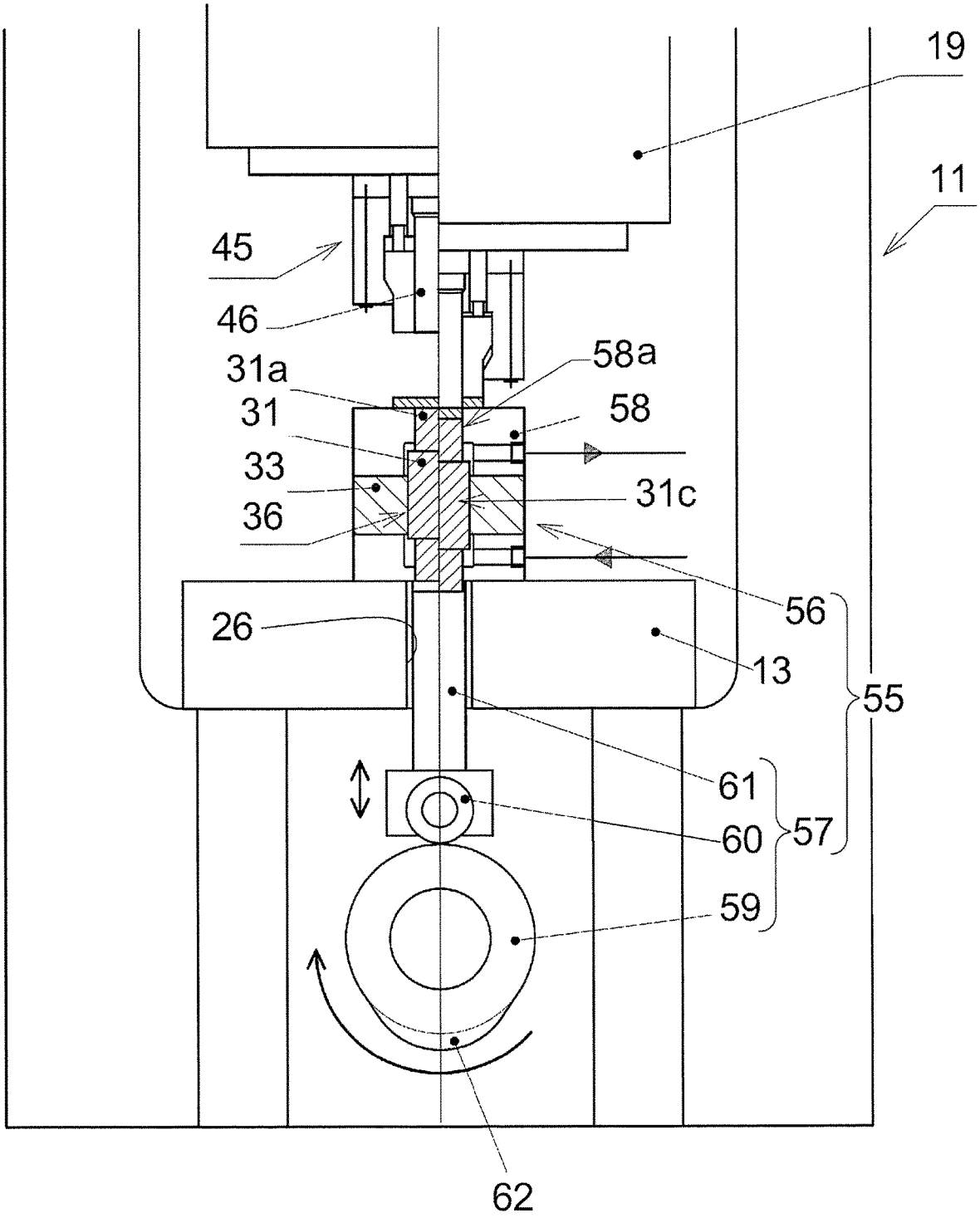
FIG. 3 is a configuration diagram showing another embodiment of a die cushion device of the present invention.

A die cushion device 55 shown in FIG. 3 is equipped with a friction die cushion 56 substantially similar to the friction die cushion 15 shown in FIG. 2B and a knockout mechanism 57 for pushing up the friction pin 31. No air cushion device is equipped. The illustration of an oil supply circuit for supplying lubricating oil to the friction die cushion 56 is omitted.

In the friction die cushion 56 of this embodiment, the upper portion 31*a* of the friction pin 31 also serves as a counter, and a die 58 serving as a spacer is arranged on the hub 33. Other points, especially the configuration of the intermediate portion 31*c* of the friction pin 31 and the configuration of the friction hole 36 of the hub 33 are the same as those of the friction die cushion 15 shown in FIG. 2B. The upper die 45 is similar to the upper die of FIG. 1. The contour of the punch 46 of the upper die 45 and the contour of the upper portion 31*a* of the friction pin 31 which also serves as a counter are both circular, and the guide hole 58*a* formed in the die 58 is also circular. Therefore, it can be configured such that an O-ring groove is formed on the inner circumferential surface of the guide hole 58*a* and an O-ring is fitted therein to seal the gap between the inner circumferential surface of the guide hole 58*a* and the upper portion 31*a* of the friction pin 31.

The knockout mechanism 57 is composed of a cam 59 rotatably provided below the bolster 13, a cam drive mechanism (not illustrated) for rotating the cam 59 synchronously with the up-and-down motion of the slide 19, a cam follower 60 that moves up and down in contact with the outer peripheral surface of the cam 59, and a knockout pin 61 for transmitting the up-and-down motion of the cam follower 60 to the friction pin 31. As the cam 59, a plate cam with a protrusion 62 protruding smoothly on a part of a disk is adopted. Note that the cam 59 may be a cam of other forms such as a groove cam. The knockout pin 61 is slidably provided in the through-hole 26 formed in the bolster 13. The cam 59 can be rotationally driven by, for example, transmitting the rotational motion of a crankshaft driving the slide 19 of the press machine 11 via a connecting shaft.

Further, the cam 59 can also be rotationally driven independently by a motor provided separately from a crankshaft. In this case, a control device for controlling the motor by detecting the operating state of the press machine 11 is provided. As the motor, a servomotor is preferably adopted since the timing of the up-and-down motion of the knockout pin 61 can be freely set. Instead of the cam mechanism, other mechanisms that convert a rotational motion into a linear reciprocating motion, such as, e.g., a screw mechanism and a rack-pinion mechanism, can also be adopted. The mechanism for returning these friction pins 31 to their original positions can also be applied to the friction die cushion 15 independent from the dies as shown in FIG. 1 and FIG. 2B, the friction die cushion 56 integrated with the dies of FIG. 3, and the friction die cushion used for a drawing die of FIG. 4A and FIG. 4B.

The die cushion device 55 shown in FIG. 3 is not equipped with an air cushion device. Therefore, when the slide 19 is lowered, the force of clamping the workpiece W between the punch 46 and the counter punch (here, the upper portion 31*a* of the friction pin 31 in this embodiment) is provided only by the friction die cushion 56. Further, even in cases where the frictional force is not strong, there is no upward urging force, so it can be used as a cushion equipped with a so-called locking mechanism. For this reason, the timing to take out the punched product from the die can be set freely.

Figure 4A:
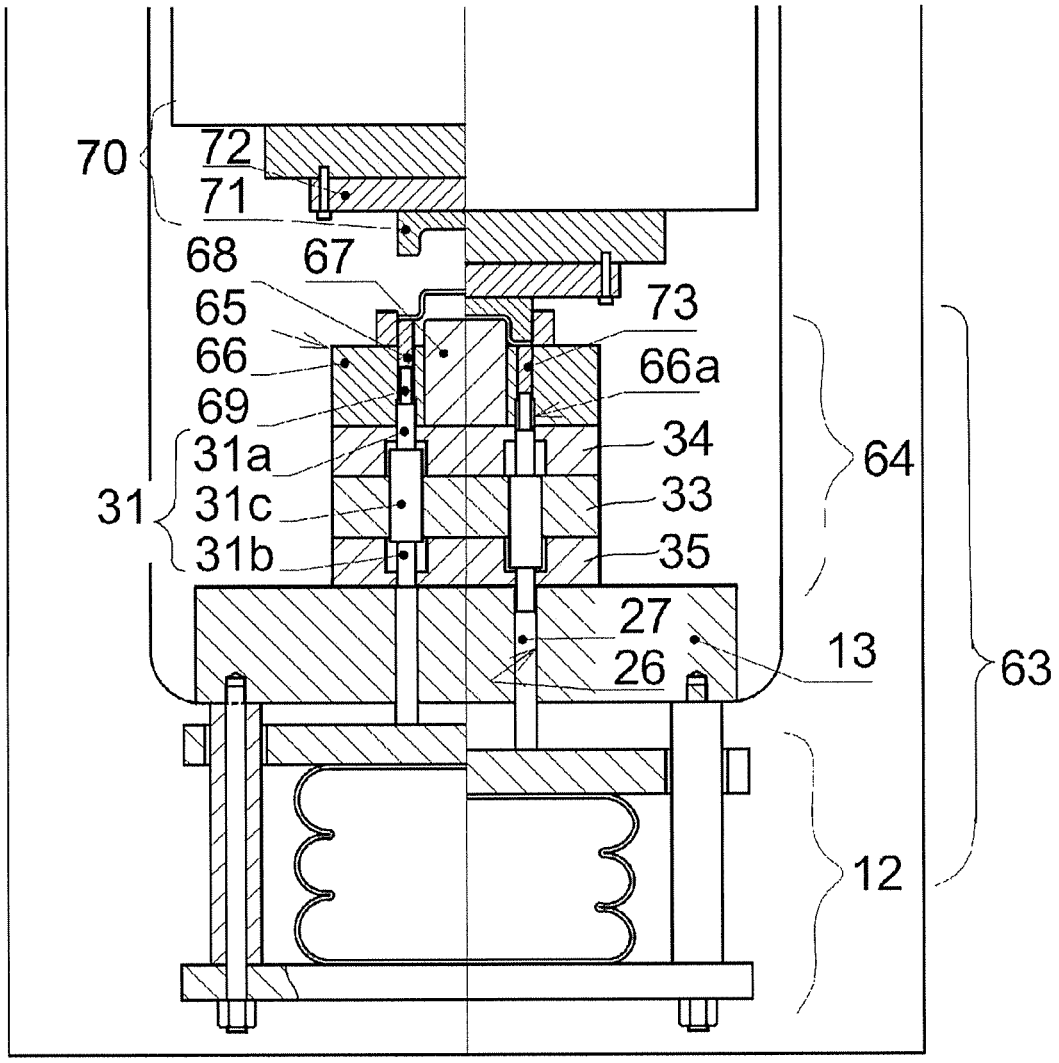
Figure 4B:
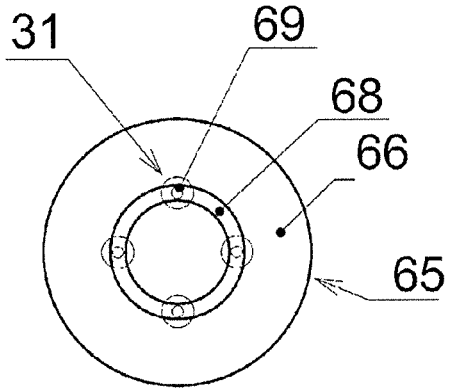

The die cushion device 63 shown in FIG. 4A and FIG. 4B is equipped with an air cushion device 12 and a friction die cushion 64. As a die, a die of a drawing type (deep drawing type) is adopted, and the upward urging force of the die cushion device 12 is used for a blank holder of a workpiece. The lower die 65 is composed of a base 66, a punch 67 arranged in a manner such that its upper portion protrudes at the center of the base 66, a cushion ring 68 provided in a manner as to be movable up and down with respect to the base 66 so as to surround the punch 67, four spacer pins 69 disposed below the cushion ring 68 to support the cushion ring 68. The upper die 70 that works with the lower die 65 is equipped with a die 71 that fits on the punch 67 in a manner as to clamp the workpiece W, and a die plate 72 for holding the die 71.

The cushion ring 68 of the lower die 65 is accommodated slidably up and down in an annular groove 73 provided in the upper surface of the base 66, and the spacer pins 69 are slidably accommodated in corresponding four holes 66*a* penetrating from the bottom of the annular groove 73 to the lower surface of the base 66. As shown in FIG. 4B, four spacer pins 69 are arranged at equal intervals in the circumferential direction.

The friction die cushion 64 is composed of four friction pins 31 arranged concentrically below respective spacer pins 69, a hub 33 for slidably holding the friction pins 31 in an interference fit state, and spacers 34 and 35 arranged on and under the hub 33. The friction pin 31, the hub 33, and the upper and lower spacers 34 and 35 are the same as those of the friction die cushion 15 shown in FIG. 1 and FIG. 2B except that the number of the friction pins 31 and friction holes 36 is four, respectively.

The friction die cushion 64 is also the same as the friction die cushion 15 shown in FIG. 2B in that the upper portion 31*a* and the lower portion 31*b* of the friction pin 31 are small in diameter and frictional resistance is caused by sliding friction between the outer peripheral surface of the intermediate portion 31*c* and the inner surface of the friction hole 36 of the hub 33. In the bolster 13, through-holes 26 are formed at four positions in the front, rear, left, and right of the center, and cushion pins 27 are accommodated in respective through-holes 26 in an upwardly and downwardly movable manner. In consideration of general versatility of the positions of the cushion pins 27, in some cases, a large number of through-holes 26 are formed in the bolster 13 in a grid pattern or a large rectangular opening is formed in place of through-holes.

Figure 5A:
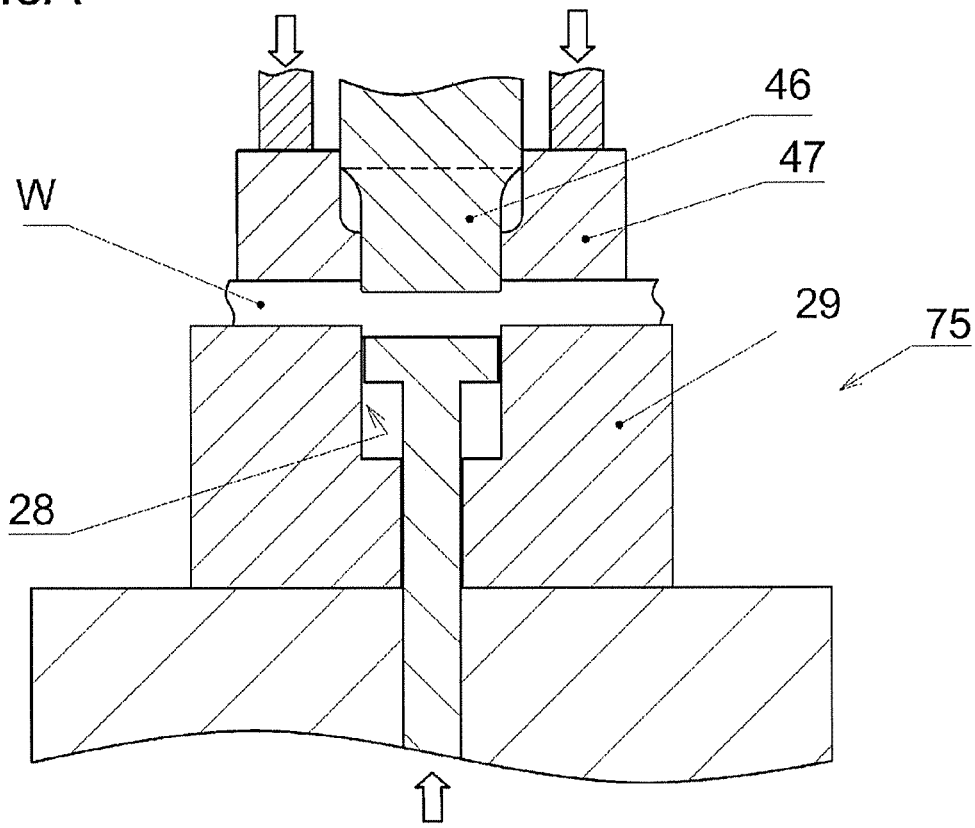
Figure 5B:
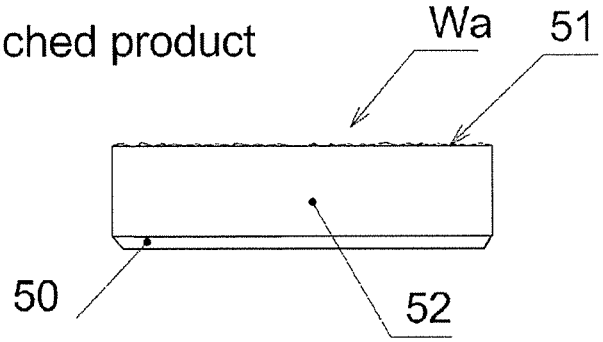

FIG. 5A shows the operating state of the blanking die 75, which is almost the same as that shown in FIG. 1, especially at the time of starting blanking of a workpiece W. In this state, the workpiece W is clamped between the blank holder 47 and the upper surface of the die 29, and the lower end of the punch 46 is somewhat biting into the upper surface of the workpiece W. Similarly, the upper peripheral edge of the punching hole 28 of the die 29 is biting into the lower surface of the workpiece W. The clearance between the punching hole 28 and the punch 46 is as narrow as about 0.01 mm to about 0.03 mm. When the punch 46 is further lowered from this state, the workpiece W is sheared substantially at a right angle with respect to the workpiece W at a position between a portion corresponding to the lower surface periphery of the punch 46 and a portion corresponding to the peripheral edge of the die punching hole 28. For this reason, fine shearing (fine blanking) causing less shear droop and burr is performed (see FIG. 5B).

Figure 6A:
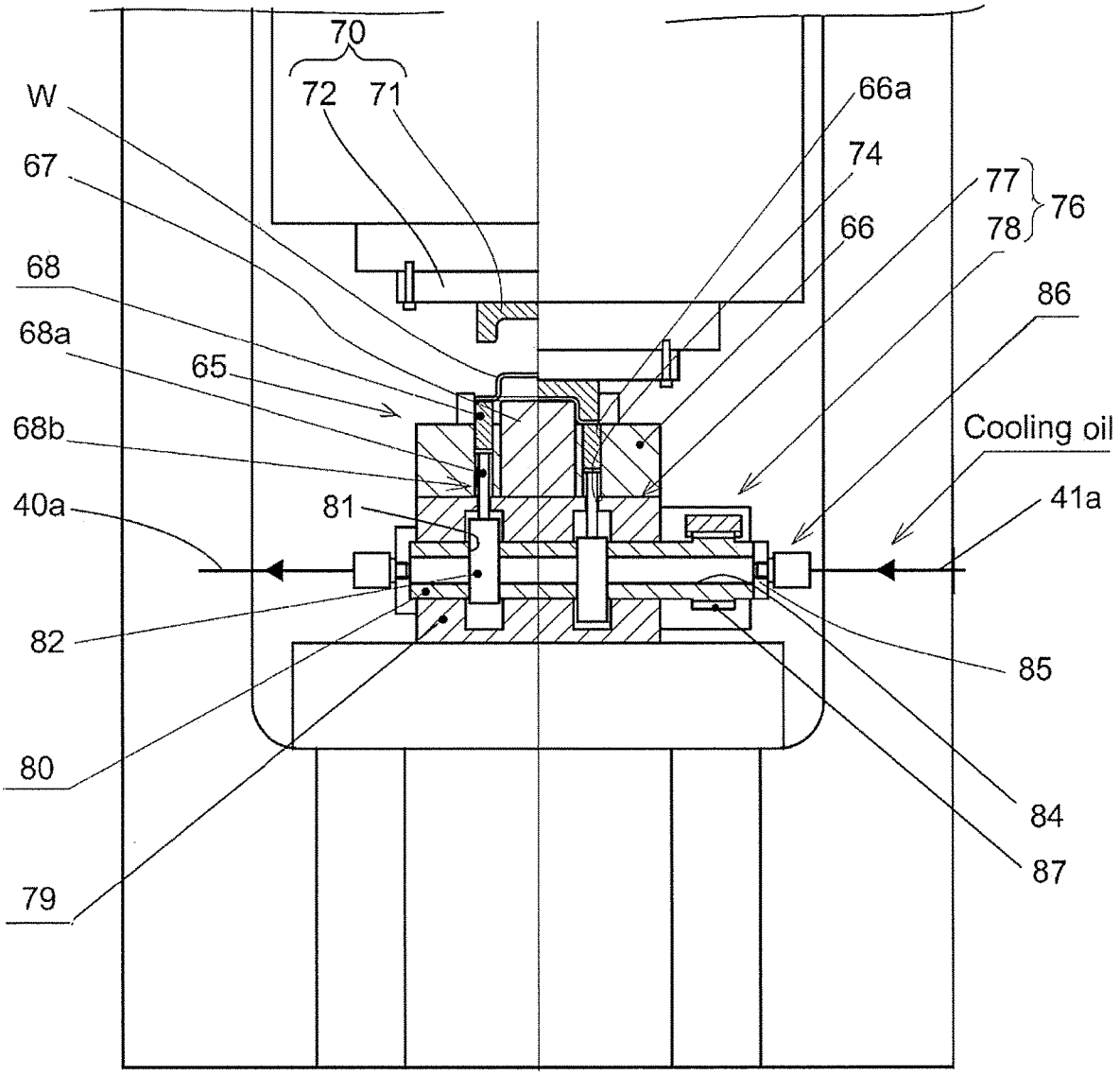
Figure 7A:
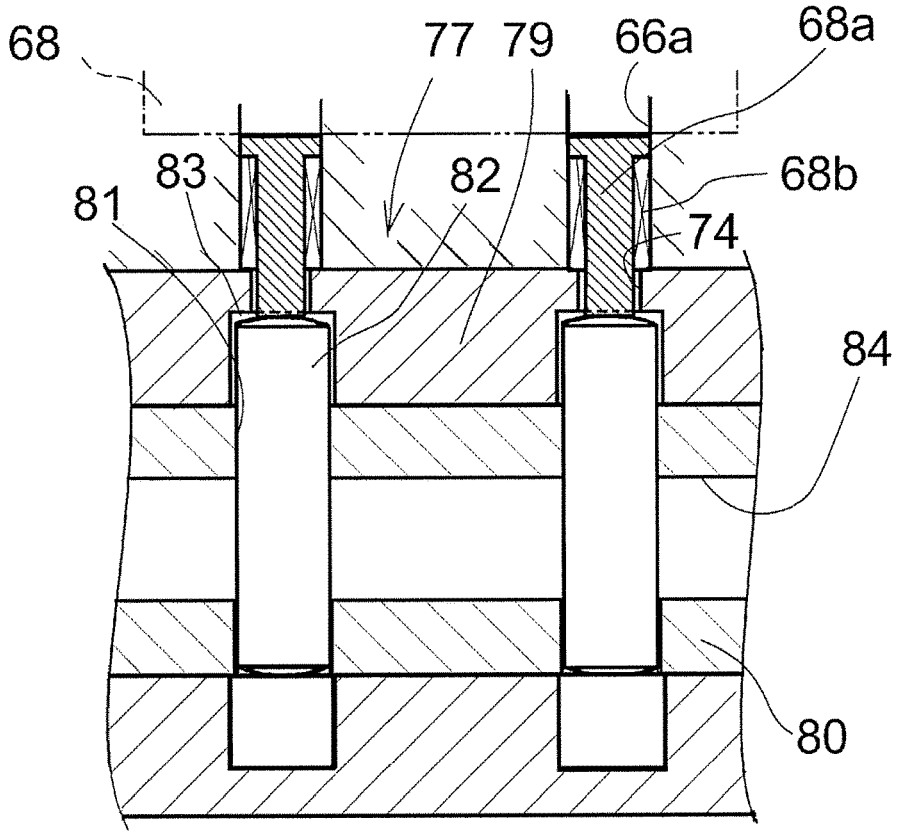
Figure 7B:
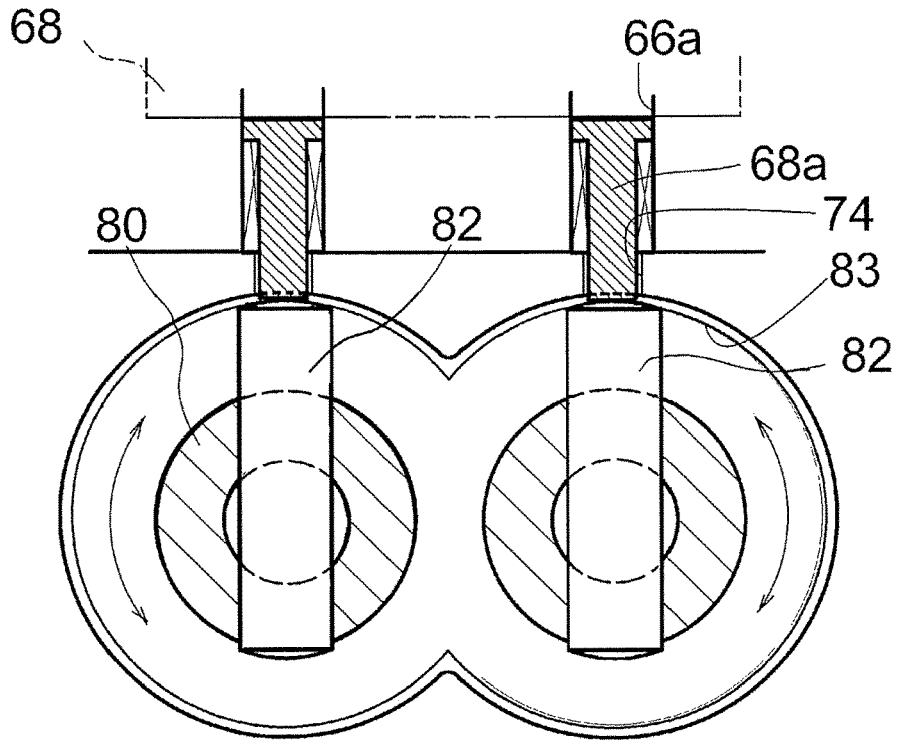

A die cushion device 76 shown in FIG. 6A is equipped with a friction die cushion 77 and a reversing mechanism 78 or turn-over mechanism which reverses the entire friction die cushion 77 every time processing is performed. The friction die cushion 77 is composed of a housing 79, a cylindrical hub 80 arranged in the housing 79 so as to extend in the left-right direction and rotatably supported about its own axis, and a friction pin 82 slidably fitted in a friction hole 81 formed in the hub 80 in the diameter direction in an interference fit state. In order to avoid interference with the portion of the friction pin 82 protruding from the hub 80, the housing 79 is provided with a cylindrical or semicircular or fan-shaped space 83 (see FIG. 7A and FIG. 7B). The materials of the hub 80 and the friction pin 82 and the dimensional relationship between the friction hole 81 and the friction pin 82 are the same as those of the friction die cushion 15 in FIG. 2A.

At the center of the hub 80, a passage and an oil pocket 84 for circulating lubricating oil serving as a cooling medium or refrigerant is formed. The oil pocket 84 opens at both ends of the hub 80 and both the ends are closed with caps 85. The oil pocket 84 is further connected to a supply pipe line 41*a* and a return line 40*a* of an oil feeding system of lubricating oil via rotary joints 86 attached to the caps 85. One end (right side in FIG. 6A) of the hub 80 is protruded largely from the housing 79, and the reversing mechanism 78 is provided around the hub 80. In this embodiment, a gear or pinion 87 is fixed around the hub 80, so that the hub 80 is reciprocally and rotatably driven by a motor and a reduction gear (not illustrated). The hub 80 may be rotated by one half revolution in the same direction. The hub 80 may be reciprocally and rotatably driven by a rack in which an air cylinder or a slide drive mechanism of a press machine is used as a driving source.

The die cushion device 76 shown in FIG. 6A can be used for a drawing die which is similar to the die of the embodiment shown in FIG. 4A. A lower die 65 is placed on the housing 79, and an upper die 70 is attached to a slide of the press machine. A hole 74 extending upward from the space 83 is formed in the housing 79. The lower die 65 includes a base 66, a punch 67, and a cushion ring 68, and the cushion ring 68 is supported by four cushion pins 68*a*. The cushion pin 68*a* is constantly urged upward by a lift spring 68*b* (see FIG. 7A). The cushion pin 68*a* is accommodated in a hole 66*a* formed in the base 66 of the lower die 65 so as to freely move up and down. These holes 66*a* are formed at portions corresponding to the holes 74 of the housing 79, and are normally arranged equally in the circumferential direction. The upper die 70 is similar to the upper die shown in FIG. 5A and is equipped with a die 71.

Figure 6B:
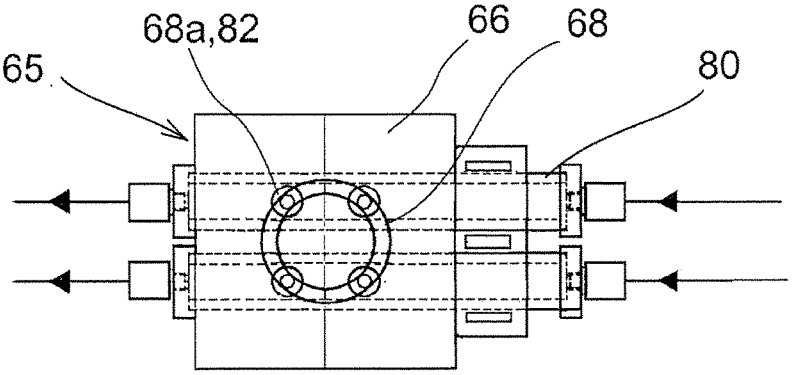

As shown in FIG. 6B, two hubs 80 are provided in front and rear so as to extend in the left-right direction in parallel with each other. The friction pins 82 supported by respective hubs 80 and the aforementioned cushion pins 68*a* are concentrically arranged up and down. Both ends of the friction pin 82 are each formed in a substantially convex spherical shape, and the lower end of the cushion pin 68*a* is formed into a substantially concave spherical surface corresponding to the spherical surface. With this, the relief of the cushion pin 68*a* can be minimized, and the position of the cushion pin 68*a* can be stabilized.

Figure 8:
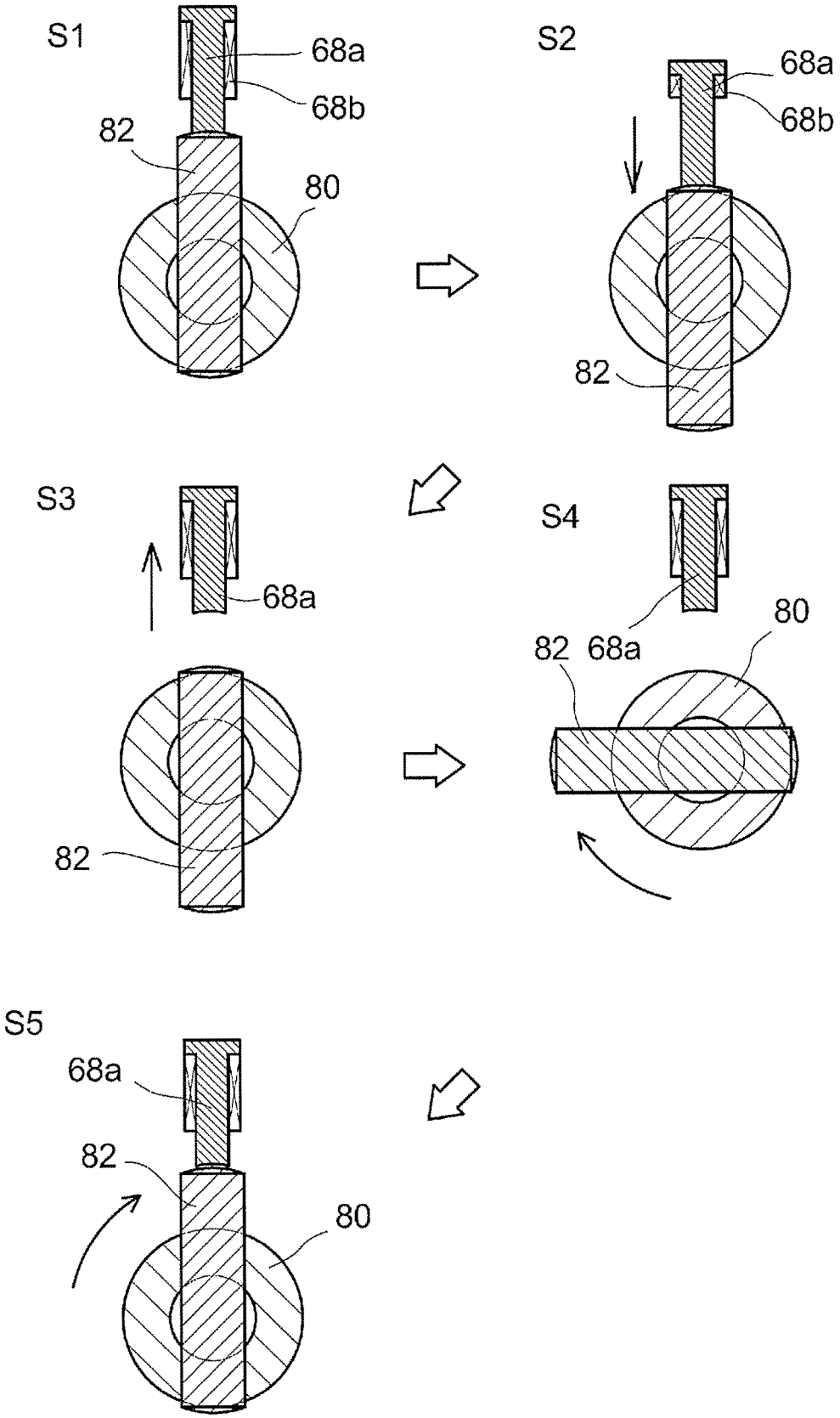
FIG. 8 is a schematic process diagram showing the operating state of the die cushion device shown in FIG. 6A.

In the die cushion device 76 configured as described above, the friction pin 82 is driven by the die (see the reference numeral 71 in FIG. 6A) via a workpiece and the cushion pin 68*a* in a state in which its upper end is protruded from the hub 80 (see S1 in FIG. 8, upper left) and therefore displaced downward (S2 in FIG. 8, see the upper right). With this, the lower end of the friction pin 82 is protruded downward from the lower surface of the hub 80. Next, after the slide of the press machine is raised and therefore the die 71 is raised (S3), the hub 80 is rotated by 180 degrees (S4 and S5). With this, the friction pin 82 returns to the state in which the end portion of the friction pin 82 is protruded from the upper surface of the hub 80. As a result, it becomes possible to process a workpiece again while receiving a cushion force with the die 71.

When reversing from this state, the hubs 80 may be rotated in the same direction or may be rotated in opposite directions. By rotating the hubs 80 in opposite directions so that the protruded end portion of the friction pin 82 turns outside area of the space 83, it becomes possible to narrow the core-to-core distance of the hubs 80. As the driving source of the hub 80, other than the aforementioned motor, a gas/liquid cylinder, or a vertical movement of a slide, or a rotation of a crankshaft, etc., may be used. In the gap between the friction pin 82 and the hub 80, lubricating oil is supplied from the oil pocket 84 provided at the center of the hub 80. The lubricating oil is supplied to the oil pocket 84 from the supply pipe line 41*a* and flows out of the return line 40*a*. The supply pipe line 41*a* is filled with low temperature lubricating oil, and therefore lubrication and cooling can be performed simultaneously by the lubricating oil.

In the embodiments shown in FIG. 1 to FIG. 5, in preparation for the next processing, the friction pin is returned to its original position using the urging force of the air cushion device (FIG. 1 and FIG. 4A) or the knockout mechanism (FIG. 3). In contrast, in the die cushion device 76 shown in FIG. 6A, by reversing the entire friction die cushion 77, the friction pin 82 can be returned to its original state without changing the relative positional relationship between the friction pin 82 and the hub 80. Therefore, the energy efficiency is high. In FIG. 6A, a die cushion device using a friction die cushion used for a drawing die is described, but the die cushion device can also be used for a fine cutting die similar to that shown in FIG. 1. In that case, it is enough to use one cushion pin.

Figure 9A:
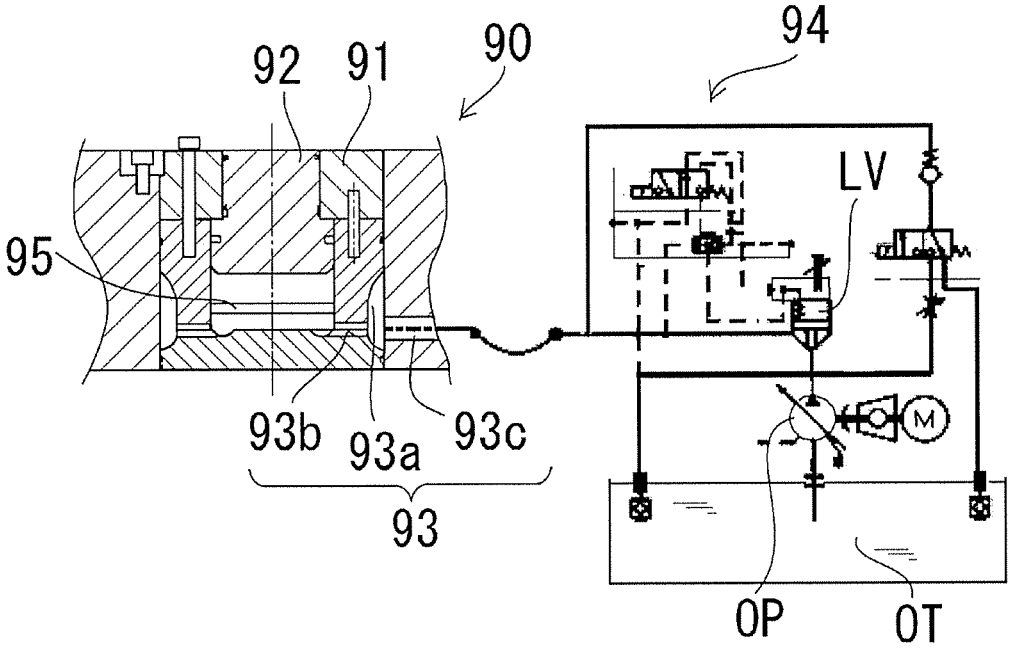

A die cushion device 90 shown in FIG. 9A is a so-called relief type die cushioning device equipped with a cylinder 91 arranged below the press machine 11, a piston 92 accommodated in the cylinder 91 in an upwardly and downwardly movable manner, a communication path 93 for applying pressure to the hydraulic oil in the cylinder 91 and guiding the hydraulic oil to the outside when the piston 92 is lowered, and a hydraulic circuit 94 for exerting a cushion force by applying back pressure to the hydraulic oil to be discharged to the outside. The communication path 93 includes an annular space 93*a* formed on the lower outer periphery of the cylinder 91, a plurality of communication holes 93*b* communicating the inside of the cylinder 91 and the annular space 93*a*, and a communication passage 93*c* formed in the frame 18 or bolster 13 of the press machine 11. The hydraulic circuit 94 is provided with an oil pump OP for supplying hydraulic oil to the cylinder 91 and a relief valve LV for releasing the hydraulic oil when the inner pressure of the cylinder 91 exceeds a predetermined value.

The die cushion device 90 further includes a frictional force cushion area 95 formed on the inner surface of the cylinder 91 circularly in a band shape in a manner as to slidably fit on the outer surface of the lower end of the piston 92 and its vicinity in an interference fit state. The frictional force cushion area 95 is smaller in inner diameter than the other area by the tightening margin. The frictional force cushion area 95 and the piston 92 serves as a friction die cushion which exerts a cushion force only at a specific position near the bottom dead center of the press machine.

Figure 9B:
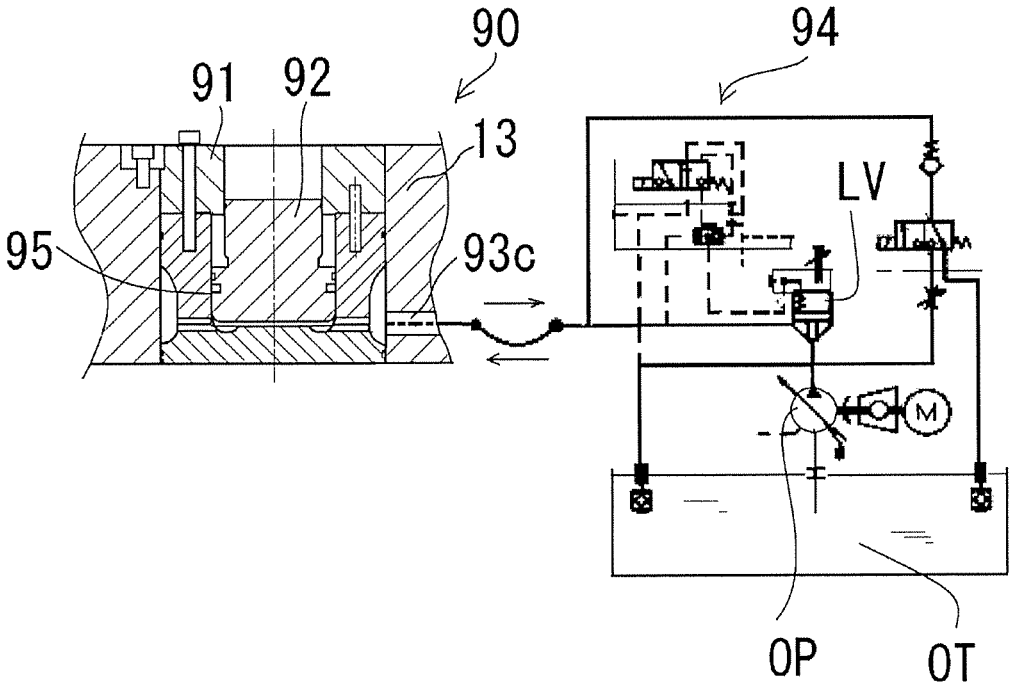

In this relief type die cushion device 90, when a counter and a cushion ring are pressed downward by an upper die to process a workpiece, the hydraulic oil in the cylinder 91 is led to the hydraulic circuit 94 side via the communication path 93 (see FIG. 9B). At that time, the pipeline resistance of the hydraulic oil passing through the communication path 93 and the resistance generated when the hydraulic oil passes through the relief valve LV become the cushion force. The hydraulic cushion force can be preset by the relief valve LV of the hydraulic circuit 94. Before the piston 92 reaches the frictional force cushion area 95, the cushion function is performed only by the aforementioned hydraulic pressure force. When the piston 92 reaches the frictional force cushion area 95, the cushion function caused by the combination of the hydraulic cushion force and the frictional force combined is exerted.

Figure 10:
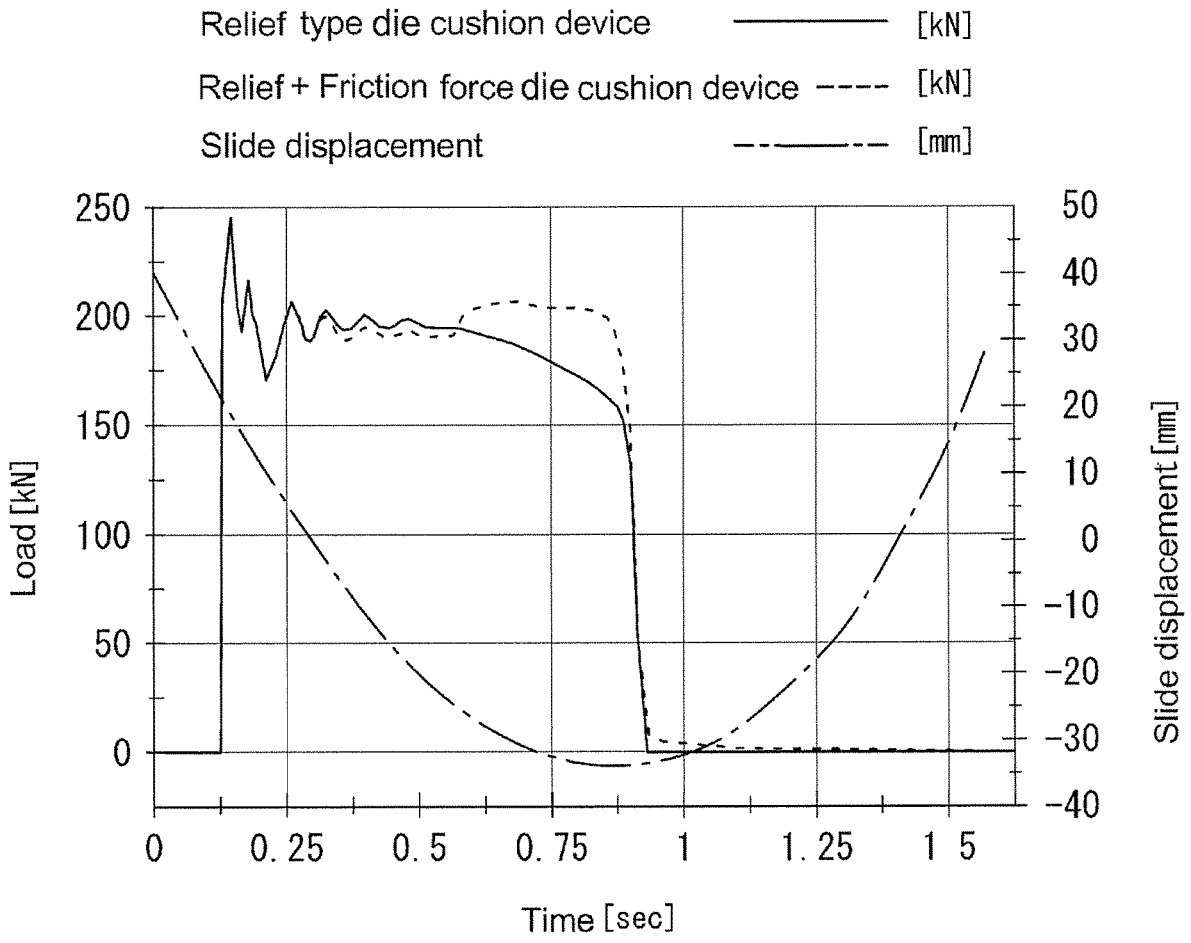
FIG. 10 is a graph showing the operation of the die cushion device of FIG. 9A.

When the slide is raised (see the dot-dash line in FIG. 10), the hydraulic oil is supplied from the hydraulic circuit 94 into the cylinder 91 to raise the piston 92. At this time, the frictional force becomes resistance to hinder the piston 92 from rising up. However, once the piston 92 passes the frictional force cushion area 95, unnecessary frictional resistance disappears.

By the way, in the relief type die cushion device 90, as the flow velocity increases, the viscous resistance increases and as the flow velocity increases, the viscous resistance decreases. Therefore, the cushion ability has a speed dependence. For this reason, as shown by the solid line and the dot-dash line in FIG. 10, there is a pressure override characteristic in which the cushion ability decreases near at the bottom dead center where the stroke speed decreases. Further, although the override characteristic is reduced if the flow passage area of the relief valve is reduced with a servo valve or the like, a phenomenon occurs in which the product is pushed back by the cushion residual pressure after passing the bottom dead center.

In the die cushion device 90 of FIG. 9A and FIG. 9B, in order to cope with these phenomena, the friction die cushion is also used for a hydraulic cylinder device including the cylinder 91 and the piston 92. Therefore, the decrease in cushion force due to the override characteristic near at the bottom dead center can be compensated, and the stable cushion ability can be maintained to the bottom dead center (see the broken line in FIG. 10).

In the aforementioned embodiments, all of the frictional force generating mechanisms are used for a die cushion of a press machine. However, the frictional force generating mechanism of the present invention is not limited thereto but can be applied to various devices, such as, e.g., a friction damper which attenuates vibrations by sliding frictional resistance, a knockout overload prevention device, and a press overload protector device. In the aforementioned embodiments, a case in which the hub is cooled by lubricating oil or cooling oil is described, but the hub can be cooled with other cooling medium or refrigerant, such as, e.g., water and air.

[Test 1: Interference Fit Sliding: Element Test]

Figure 11A:
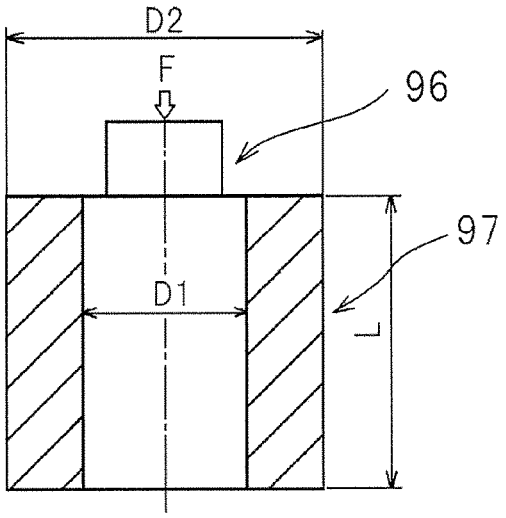
FIGS. 11A and 11B are schematic configuration diagrams of a friction pin and a hub used for an element test of interference fit sliding.

Next, the element test of the interference fit sliding performed to verify the practicality and effect of the sliding frictional force generation mechanism of the present invention will be described. The friction pin (shaft member) 96 of Example 1 used for this test had the general shape shown in FIG. 11A and FIG. 11B. Specifically, the friction pin 96 had the shape and dimensions shown in FIG. 11C. The unit of the numeral is "mm (millimeter)". The mark "Φ(o+/)" in the figure denotes a diameter. The material of the friction pin 96 was S45C (JIS), and was set to Hs 35±3 by refining of quenching and tempering. On the other hand, the material of the hub 97 was a S45C raw material (basically no heat treatment was subjected). The inner diameter D1 of the hub (hole member) 97 was slightly smaller (by about 0.03 mm) than the outer diameter D1 of the friction pin 96. The outer diameter D2 of the hub was 64 mm and the height L was 51 mm. No oil groove was formed in the hub 97.

Figure 11B:
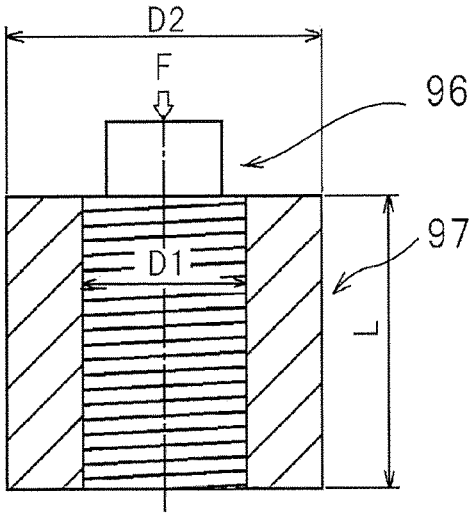

The friction pin 96 was immersed in liquid nitrogen to be cooled and inserted into the hole 97*a* of the hub 97 after the boiling of the liquid nitrogen is ceased. Thereafter, the friction pin 96 was returned to normal temperature to make an interference fit state. Next, the friction pin 96 was pressed in the axial direction by a press machine and pulled out of the hub 97, and the state of the surface was observed. Five samples were prepared, and the aforementioned interference fit and pulling-out were repeated six times respectively. In the first test, a friction pin 96 to which the oil groove shown in FIG. 11A was not formed was used. In the second and subsequent tests, as shown in FIG. 11B, a friction pin 98 to which an oil groove 98*a* was formed was used.

Figure 11C:
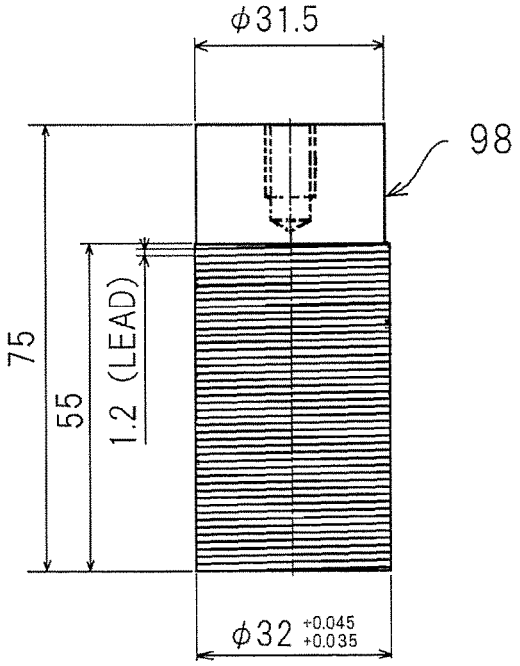
FIG. 11C is a detailed view of the friction pin.
Figure 11D:
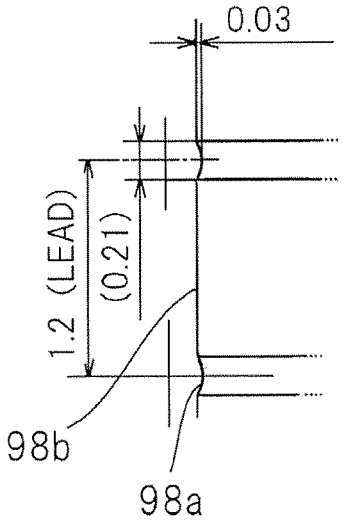
FIG. 11D is an enlarged view showing an oil groove.

As shown in FIG. 11D, the oil groove 98*a* had an arc shape with a width of 0.21 mm and a depth of 0.03 mm. As shown in FIG. 11C, the oil groove 98*a* was spirally formed at intervals of 1.2 mm (Lead) in the axial direction. A plurality of annular oil grooves may be arranged and connected by an oil groove extending in a direction parallel to the axis. In either case, the cylindrical surface between the oil grooves 98*a* served as a sliding surface 98*b*.

The number of test samples was five, Sample No. 1 to No. 5. Among them, in Sample No. 1, No. 3, and No. 5, friction pins 96 and 98 were cooled to about −180° C. with liquid nitrogen and then inserted into a hub 97 to thereby perform a cold-fit. In Sample No. 2 and No. 4, a shrink fit method in which a hub 97 was heated to 150° C. and then inserted into a friction pin 96 of normal temperature was inserted was adopted.

In the test, six cold-fit/extraction (pulling-out) tests were conducted and the surface roughness Ra before and after the test was measured. Furthermore, an applied load at each cold-fit/extraction was measured. The surface roughness Ra of each of the friction pins 96 and 98 and the hub 97 before and after the test is shown in Table 1. In Table 1, the static friction coefficients μ obtained by inversely calculating the generating surface pressure from the applied load and tightening margin at the time of the first to sixth pulling-out are also shown. As a surface roughness measuring instrument, a roughness measuring instrument Surftest SJ-301 manufactured by Mitsutoyo Corporation was used. The unit of the surface roughness Ra is "μm".

TABLE 1

| Sample No. | 1 | 2 | 3 | 4 | 5 |
|---|---|---|---|---|---|
| Pin: Initial surface roughness Ra (measured value) | 0.12 | * | 0.13 | ** | 0.19 |
| Hub: Initial surface roughness Ra (measured value) | 0.18 | | 0.21 | | 0.20 |
| $1^{st}$ time (μ inverse calculation value) | 0.217 | | 0.175 | | 0.25 |
| $2^{nd}$ time (μ inverse calculation value) | 0.304 | | 0.223 | | 0.467 |
| $3^{rd}$ time (μ inverse calculation value) | 0.321 | | 0.336 | | 0.342 |
| $4^{th}$ time (μ inverse calculation value) | 0.246 | | *** | | 0.253 |
| $5^{th}$ time (μ inverse calculation value) | 0.21 | | | | 0.23 |
| $6^{th}$ time (μ inverse calculation value) | 0.17 | | | | 0.21 |
| Pin: Surface roughness Ra after the test (measured value) | 0.11 | | | | 0.18 |
| Hub: Surface roughness Ra after the test (measured value) | 0.15 | | | | 0.18 |

As can be seen from Table 1, In Sample No. 1: Surface roughness Ra (pin: 0.12 μm, hub: 018 μm) and Sample No. 5: Surface roughness Ra (pin: 0.19 μm, hub: 0.20 μm), the friction coefficient decreases as the number of tests increases, and after the $6^{th}$ tests, the surface roughness was lower than that before the test. That is, the surface was smoothed by the sliding test.

On the other hand, in Sample No. 3 in which the surface roughness Ra of the friction pins 96, 98 was 0.13 μm and the surface roughness Ra of the hole 97*a* of the hub 97 was 0.21 μm, as the number of sliding increases, the friction coefficient μ increased and galling occurred at the friction pin 98 during the $4^{th}$ sliding test, so the test was terminated (***). Although the reason is not clear, when the surface roughness is large, there is a portion that partially and strongly hits, and therefore there is a possibility that the lubricating oil was not supplied sufficiently. In Sample No. 2 (*) and Sample No 4 (**) in which a shrink fit was performed, seizure occurred immediately after the start of the test, so it was substantially impossible to conduct a test. In the case of a shrink fit, there is a possibility that a uniform interference fit could not be made or the lubrication film on the surface was destroyed.

[Test 2: Diameter Measurement, Surface Roughness Measurement]

Figure 12A:
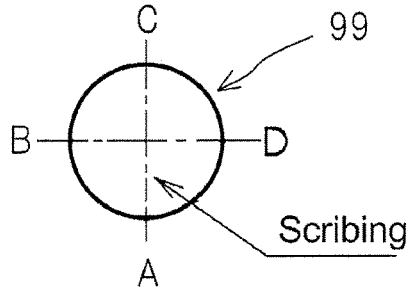
FIGS. 12A and 12B are a plan view and a front view of the friction pin used for a durability sliding test.
Figure 12B:
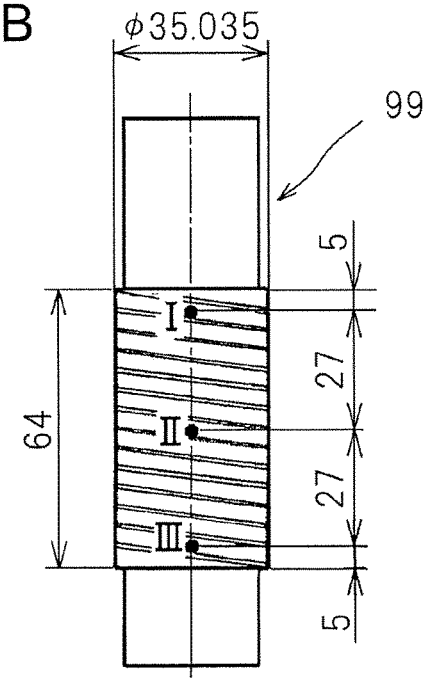
Figure 13A:
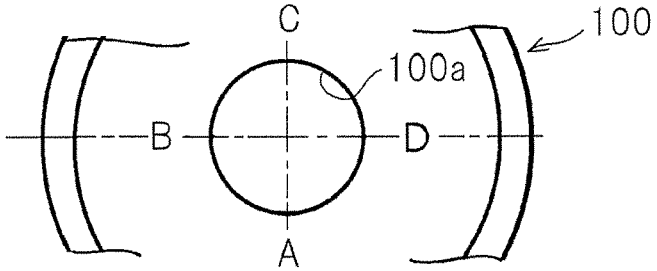
FIG. 13A and FIG. 13B are a plan view and a longitudinal cross-sectional view of a main part of a hub used for the durability sliding test.
Figure 13B:
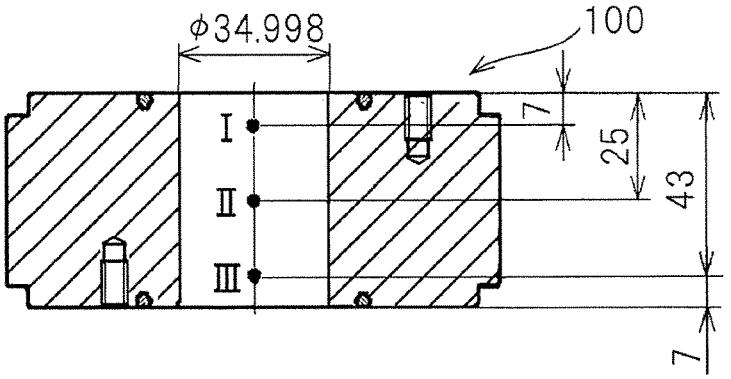

Next, a friction pin 99 and a hub 100 of Example 2 shown in FIG. 12 and FIG. 13 were prepared, and the surface roughness and the outer diameter at the time of preparation and after the test were measured. The outer diameter of the sliding portion of the friction pin 99 was about 35.035 mm and the length was 64 mm. On the sliding portion, an oil groove 99*a* of a semicircular cross-section having a radius of 0.4 mm shown in FIG. 14C was spirally formed. The portion between the adjacent grooves 99*a* was served as a sliding surface 99*b*. In the region near the oil groove 99*a* of the sliding surface 99*b*, a loose tapered flank face 99*c* was formed.

The surface hardness of the inner surface of hole 100*a* of the hub 100 is lower than the surface hardness of the friction pin 99. Specifically, the friction pin 99 has an outer diameter of 35.035 (see Table 2, the material is DC53 (die steel manufactured by Daido Steel Co., Ltd., equivalent to SKD11 (JIS)). The surface hardness HRC (Rockwell hardness C scale) was set to 60±2 by quenching and high temperature tempering. Further, a low temperature TIC treatment (titanium carbide film treatment) was carried out.

In the hub 100, the inner diameter of the hole 100*a* was about 34.998 mm, the material was SKD61, and the hardness HRC was set to 47±2 by quenching and high temperature tempering. Further, a radical nitriding treatment was performed. The hole 100*a* of the hub 100 had the shape and dimensions shown in FIG. 13A and FIG. 13B. No oil groove was formed.

The measured values of the surface roughness and the outer diameter at the time of creating a friction pin are shown in Table 2. The measurement positions of the surface roughness were set at the positions A and B in the circumferential direction of FIG. 12A and in the positions I, II, and III in the axial direction of FIG. 12B, i.e., 6 positions in total. As the measuring instrument, a surface roughness measuring instrument Surftest SJ-301 manufactured by Mitsutoyo Corporation was used. The measurement points of the outer diameter were set to the positions I, II, and III in the axial direction of FIG. 13B between A-C and between B-D in FIG. 13A, which is 6 in total. As the measuring instrument, a micro gauge manufactured by Mitsutoyo Corporation, and the unit was "μm".

TABLE 2

Pin: Initial State

| | Surface Roughness Ra (μm) | | Outer Diameter (mm) | |
|---|---|---|---|---|
| | A | B | A-C | B-D |
| I | 0.08 | 0.08 | 35.033 | 35.033 |
| II | 0.09 | 0.08 | 35.034 | 35.034 |
| III | 0.09 | 0.10 | 35.033 | 35.033 |

The measurement results of the surface roughness of the inner surface of the hole 100*a* at the time of creating the hub 100 are shown on the left side of Table 3. The measurement positions were set at the positions A and B in the circumferential direction of FIG. 13A and in the positions I, II, and III in the axial direction of FIG. 13B, i.e., 6 positions in total. Also, the measured results of the inner diameter at the time of creating the hub 100 are shown on the right side in Table 3. The measurement positions were set at the positions A-C and B-D in the circumferential direction and the positions I, II, and III in the axial direction, i.e., 6 positions in total. The inner surface of the hole 100*a* was rough as shown by the photomicrograph in FIG. 15A.

TABLE 3

Hub: Initial State

| | Surface Roughness Ra (μm) | | Inner Diameter (mm) | |
|---|---|---|---|---|
| | A | B | A-C | B-D |
| I | 0.04 | 0.03 | 34.998 | 34.999 |
| II | 0.03 | 0.03 | 34.998 | 34.998 |
| III | 0.04 | 0.04 | 34.997 | 34.998 |

The aforementioned friction pin 99 was immersed in liquid nitrogen to be cooled at −180° C. and then inserted into the hole 100*a* of the hub 100 to return to normal temperature. Thus, a cold-fit was performed. Thereafter, while supplying lubricating oil, the friction pin 99 was reciprocally slid by applying an axial pressing force and a pulling-out force. The temperature of the lubricating oil was maintained at 20° C. and lubricated at a flow rate of 100 cc/min and a pressure of 0.5 MPa. Galling and seizure did not occur even when the number of sliding exceeded 600,000 times. The sliding frictional resistance at this dimension was 62 kN to 64 kN and the average was 63 kN, and it was found that the variation was small.

After the test, the friction pin 99 was removed from the hub 100 and the surface roughness and the fit diameter of the surface of the friction pin 99 and the inner surface of the hole 100*a* of the hub were measured. The measurement results are shown in Tables 4 and 5.

TABLE 4

Pin: After 600,000 Times Sliding Test

| | Surface Roughness Ra (μm) | | Outer Diameter (mm) | |
|---|---|---|---|---|
| | A | B | A-C | B-D |
| I | 0.08 | 0.08 | 35.033 | 35.033 |
| II | 0.09 | 0.08 | 35.034 | 35.033 |
| III | 0.09 | 0.10 | 35.033 | 35.034 |

TABLE 5

Hub: After 600,000 times Sliding Test

| | Surface Roughness Ra (μm) | | Inner Diameter (mm) | |
|---|---|---|---|---|
| | A | B | A-C | B-D |
| I | 0.03 | 0.03 | 34.999 | 34.999 |
| II | 0.03 | 0.03 | 34.998 | 34.998 |
| III | 0.04 | 0.04 | 34.998 | 34.998 |

As can be seen by comparing Table 2 with Table 4 and by comparing Table 3 with Table 5, the surface roughness and the sliding portion diameter of the friction pin 99 and the hub 100 both before and after the sliding test of 600,000 times were almost unchanged. That is, the surface roughness Ra of the friction pin 99 before and after the test had no change except for the increase of 0.01 μm at the measurement points B and III, and it can be judged that substantially no abrasion occurred. In addition, there was no change except that the outer diameter was decreased by 0.001 mm between B and D at II and increased by 0.001 mm between B and D at III, and therefore it can be judged that substantially no abrasion occurred.

In the case of the hub 100, there was no change except that the surface roughness Ra was decreased by 0.01 μm at the measurement points A and I and the inner diameter was increased by 0.001 mm at the positions I and III between A and C respectively. This indicates that durability is sufficiently high and practical when the initial surface roughness and the sliding portion diameter finishing accuracy is sufficiently high even if sliding is repeated with a high surface pressure.

[Observation of Pin Surface Condition]

Figure 14A:
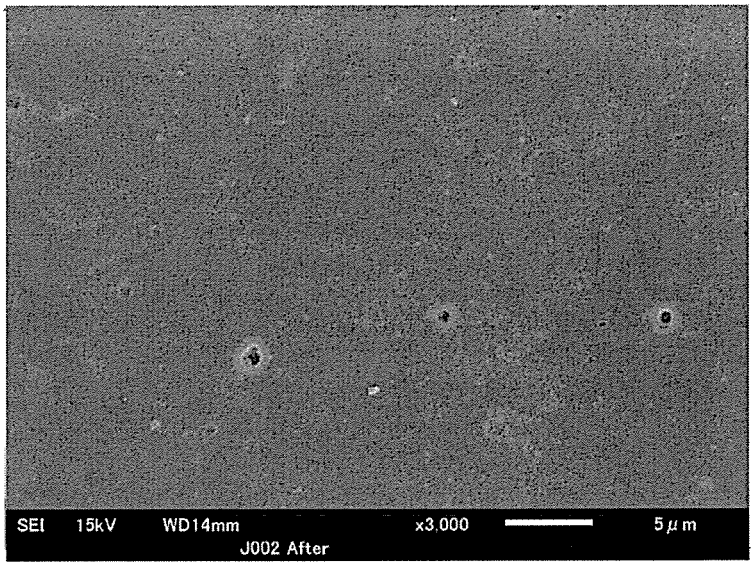
FIGS. 14A and 14B are photomicrographs each showing the roughness of the sliding portion and the non-sliding portion of the friction pin after the durable sliding test.
Figure 14B:
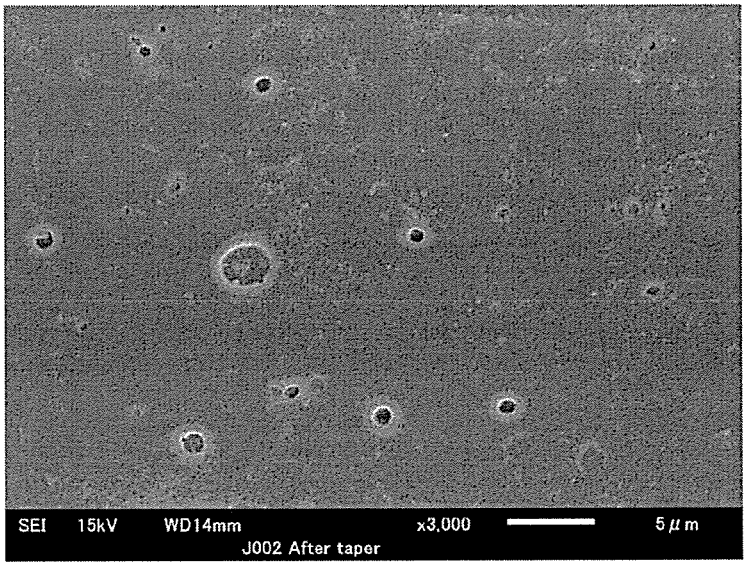
Figure 14C:
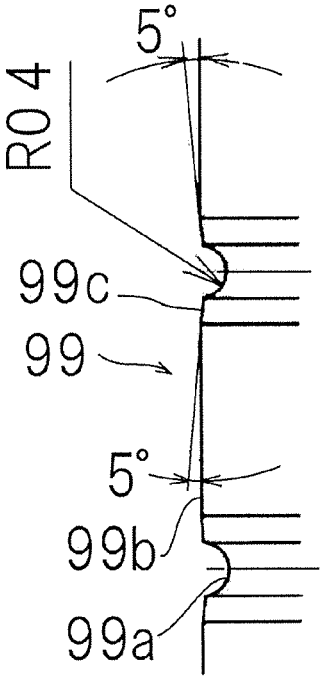
FIG. 14C is an enlarged view showing the oil groove of the friction pin.
Figure 15A:
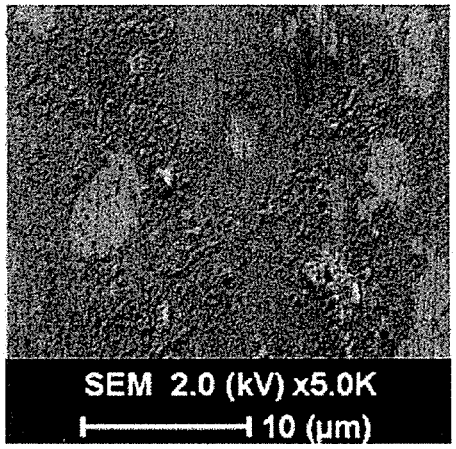
FIG. 15A and FIG. 15B are photomicrographs showing the comparison of the state of the inner surface of the hub before and after the durable sliding test.
Figure 15B:
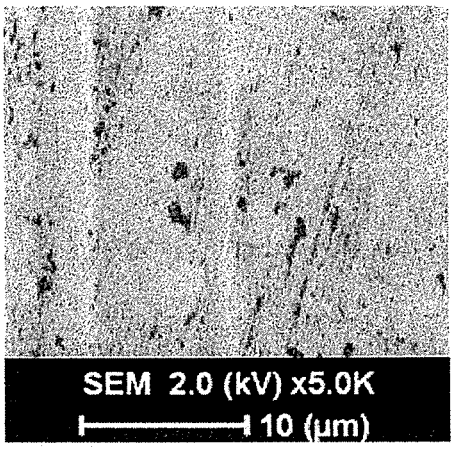

FIG. 14A and FIG. 14B show photomicrographs of the sliding surface 99*b* and the flank face 99*c* of the friction pin 99 of Example 2 after 600,000 times sliding tests, respectively. The magnification was 3,000 times. Similarly, photomicrographs of the initial and after 600,000 (six hundred thousand) times sliding tests of the hub 100 of Example 2 are shown in FIG. 15A and FIG. 15B, respectively. The magnification was 5,000 times. As can be seen from these photomicrographs, the friction pin 99 and the hub 100 had no galling on the surface after 600,000 sliding tests.

As can be seen by comparing FIG. 14A with FIG. 14B, the sliding surface 99*b* of the friction pin 99 was decreased in roughness and irregularities as compared with the flank face 99*c*. Similarly, as can be seen by comparing FIG. 15A with FIG. 15B, it is understood that the surface state (surface roughness) after the sliding test of the hub 100 was equal to or higher than the initial state (smoothing by sliding). It is thought that the surface was made smooth by lapping processing by repeating sliding under sufficient lubrication.

It should be understood that the terms and expressions used herein are used for explanation and have no intention to be used to construe in a limited manner, do not eliminate any equivalents of features shown and mentioned herein, and allow various modifications falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

DESCRIPTION OF REFERENCE SYMBOLS

10 die cushion device
11 press machine
12 air cushion device
13 bolster
14 lower die
15 friction die cushion
16 lubricating oil supply system
18 frame
19 slide
20 bellows
21 base plate
22 bolt
23 pipe
24 cushion pad
26 through-hole (of bolster)
27 cushion pin
28 punching hole
29 die
30 counter
31 friction pin
31*a* upper portion
31*b* lower portion
31*c* intermediate portion
32 holder
33 hub
34, 35 spacer
34*a*, 35*a* guide hole (of the spacer)
34*b*, 35*b* enlarged diameter portion
36 friction hole
37 oil groove
38 oil pocket
39 O-ring
40, 41 passage
41*a* supply pipe line
40*a* return line
OT oil tank
SF suction filter
OP oil pump
OC oil cooler
45 upper die
W workpiece
46 punch
47 blank holder
48 spring
49 die holder
F1 urging force of the air cushion device
F2 frictional resistance of the friction die cushion
50 shear droop
51 burrs
52 shear plane
55 die cushion device
56 friction die cushion
57 knockout mechanism
58 die
58*a* guide hole (of a die)
59 cam
60 cam follower
61 knockout pin
63 die cushion device
64 friction die cushion
65 lower die
66 base
66*a* hole (of a base)
67 punch
68 cushion ring
68*a* cushion pin
69 spacer pin
70 upper die
71 die
72 die plate
73 annular groove
74 hole (of a housing)
75 blanking die
76 die cushion device
77 friction die cushion
78 reversing mechanism (turn-over mechanism)
79 housing
80 hub
81 friction hole
82 friction pin
83 space
84 oil pocket
85 cap
86 rotary joint
87 pinion
68*a* cushion pin
68*b* lift spring
90 die cushion device
91 cylinder
92 piston
93 communication path
93*a* annular space
93*b* communication hole
93*c* communication passage
94 hydraulic circuit
95 frictional force cushion area
96 friction pin (Example 1)
97 hub
97*a* hole
98 friction pin (after oil groove processing)
98*a* oil groove
98*b* sliding surface
99 friction pin (Example 2)
99*a* oil groove
99*b* sliding surface
99*c* flank face
100 hub
100*a* hole
A, B, C, D circumferential position
I, II, III axial position

The invention claimed is:

1. A sliding frictional force generation mechanism comprising:

a metal hole member having a hole;

a metal shaft member fitted in the hole of the hole member so that the metal shaft member is slidable repeatedly and alternately in an axial direction; and a lubrication mechanism configured to supply lubricating oil serving as a cooling medium for cooling frictional heat caused by sliding between the hole member and the shaft member, wherein the shaft member is fitted in the hole in an interference fit state, wherein surface roughness Ra of an inner surface of the hole and an outer surface of the shaft member are 0.01 to 0.2 μm, and wherein an oil groove through which the lubricating oil flows is formed in at least one of the inner surface of the hole and the outer surface of the shaft member, wherein the lubricating mechanism has a supply line to supply the lubricating oil to an end of the oil groove and a return line to return the lubricating oil from another end of the oil groove, the return line being different from the supply line, wherein the both the hole member and the shaft member are made of carbon steel, and wherein at least one of or both sliding surfaces of the hole member and the shaft member is subjected to a surface hardening treatment.

2. The sliding frictional force generation mechanism as recited in claim 1, wherein a passage through which another cooling medium which is different from the lubricating oil flows is formed in at least one of the hole member and the shaft member.

3. The sliding frictional force generation mechanism as recited in claim 1, wherein the surface roughness Ra of the inner surface of the hole and the outer surface of the shaft member is 0.08 to 0.2 μm.

4. A die cushion device for a press machine, comprising:

the sliding frictional force generation mechanism as recited in claim 1; and a return mechanism configured to return the shaft member pushed in to a state before being pushed in, wherein the sliding frictional force generation mechanism is used for clamping a workpiece as a reaction force or resistance force generation source of press working.

5. A die cushion device comprising:

the sliding frictional force generation mechanism as recited in claim 1; and a reversing mechanism configured to reverse the sliding frictional force generation mechanism, wherein the hole of the hole member of the sliding frictional force generation mechanism is a through-hole, a length of the shaft member is longer than the hole, the reversing mechanism is configured to reverse the sliding frictional force generation mechanism for each pressing motion of a press machine, so that the shaft member pushed in is returned to a state before being pushed in, and the sliding frictional force generation mechanism is used for clamping a workpiece as a reaction force or resistance force generation source of press working.

* * * * *